US009190047B2

(12) United States Patent
Nakadai et al.

(10) Patent No.: US 9,190,047 B2
(45) Date of Patent: Nov. 17, 2015

(54) ACOUSTIC SIGNAL PROCESSING DEVICE AND METHOD

(71) Applicants: HONDA MOTOR CO., LTD., Tokyo (JP); KUMAMOTO UNIVERSITY, Kumamoto (JP)

(72) Inventors: Kazuhiro Nakadai, Wako (JP); Makoto Kumon, Kumamoto (JP); Yasuaki Oda, Kumamoto (JP)

(73) Assignees: HONDA MOTOR CO., LTD., Tokyo (JP); KUMAMOTO UNIVERSITY, Kumamoto (JP)

( * ) Notice: Subject to any disclaimer, the term of this patent is extended or adjusted under 35 U.S.C. 154(b) by 204 days.

(21) Appl. No.: 13/950,429

(22) Filed: Jul. 25, 2013

(65) Prior Publication Data

US 2014/0029758 A1 Jan. 30, 2014

(30) Foreign Application Priority Data

Jul. 26, 2012 (JP) ..... 2012-166276

(51) Int. Cl.
*G10K 11/175* (2006.01)
*G10L 21/0272* (2013.01)

(52) U.S. Cl.
CPC ..... *G10K 11/175* (2013.01); *G10L 21/0272* (2013.01)

(58) Field of Classification Search
None
See application file for complete search history.

(56) References Cited

U.S. PATENT DOCUMENTS 5,687,075 A * 11/1997 Stothers ..... 700/28
2003/0206640 A1* 11/2003 Malvar et al. ..... 381/93
2006/0015331 A1* 1/2006 Hui et al. ..... 704/227

FOREIGN PATENT DOCUMENTS

JP 2010-281816 A 12/2010

* cited by examiner

*Primary Examiner* — Paul Huber
(74) *Attorney, Agent, or Firm* — Squire Patton Boggs (US) LLP

(57) ABSTRACT

An acoustic signal processing device includes a frequency domain transform unit configured to transform an acoustic signal to a frequency domain signal for each channel, a filter coefficient calculation unit configured to calculate at least two sets of filter coefficients of a filter for each section having a predefined number of frames with respect to a sampled signal obtained by sampling the frequency domain signal transformed by the frequency domain transform unit for each frame such that the magnitude of a residual calculated based on a filter compensating for the difference in transfer characteristics between the channels of the acoustic signal is minimized, and an output signal calculation unit configured to calculate an output signal of a frequency domain based on the frequency domain signal transformed by the frequency domain transform unit and at least two sets of filter coefficients calculated by the filter coefficient calculation unit.

6 Claims, 16 Drawing Sheets

ACOUSTIC SIGNAL PROCESSING DEVICE AND METHOD

CROSS REFERENCE TO RELATED APPLICATIONS

Priority is claimed on Japanese Patent Application No. 2012-166276, filed on Jul. 26, 2012, the contents of which are entirely incorporated herein by reference.

BACKGROUND OF THE INVENTION

1. Field of the Invention

The present invention relates to an acoustic signal processing device, an acoustic signal processing method, and an acoustic signal processing program.

2. Description of Related Art

A sound source separation technique for separating a component by a certain sound source, a component by another sound source, and a component by noise from a recorded acoustic signal has been suggested. For example, in a sound source direction estimation device described in Japanese Unexamined Patent Application, First Publication No. 2010-281816, in order to select sound to be erased or focused, the sound source direction estimation device includes acoustic signal input means for inputting an acoustic signal, and calculates a correlation matrix of an input acoustic signal. In the sound source separation technique, if transfer characteristics from a sound source to a microphone are not identified in advance with high precision, it is not possible to obtain given separation precision.

However, practically, it is practically difficult to identify a transfer function in an actual environment with high precision. It is anticipated that the sound source separation technique is applied to remove noise (for example, an operating sound of a motor or the like) generated during operation when a humanoid robot records ambient voice. However, it is difficult to identity only noise during operation.

Accordingly, active noise control (ANC) in which the amount of prior information to be set in advance is small has been suggested. ANC is a technique which reduces noise using an antiphase wave with a phase inverted with respect to noise using an adaptive filter.

SUMMARY OF THE INVENTION

In ANC, there is a problem in that a filter coefficient which is obtained by operating the adaptive filter does not necessarily become a comprehensive optimum solution and suppresses target sound as well as noise.

The invention has been accomplished in consideration of the above-described point, and an object of the invention is to provide an acoustic signal processing device, an acoustic signal processing method, and an acoustic signal processing program which effectively reduce noise based on a small amount of prior information.

(1) According to an aspect of the invention, there is provided an acoustic signal processing device including a frequency domain transform unit configured to transform an acoustic signal to a frequency domain signal for each channel, a filter coefficient calculation unit configured to calculate at least two sets of filter coefficients of a filter for each section having a predefined number of frames with respect to a sampled signal obtained by sampling the frequency domain signal transformed by the frequency domain transform unit for each frame such that the magnitude of a residual calculated based on a filter compensating for the difference in transfer characteristics between the channels of the acoustic signal is minimized, and an output signal calculation unit configured to calculate an output signal of a frequency domain based on the frequency domain signal transformed by the frequency domain transform unit and at least two sets of filter coefficients calculated by the filter coefficient calculation unit.

(2) According to another aspect of the invention, in the acoustic signal processing device described in the aspect (1), the difference in the transfer characteristic between the channels may be a phase difference, the filter may be a delay sum element based on the phase difference, and the acoustic signal processing device may further include an initial value setting unit configured to set a random number for each channel and frame as an initial value of the phase difference.

(3) According to yet another aspect of the invention, in the acoustic signal processing device described in the aspect (2), the random number which is set as the initial value of the phase difference may be a random number in a phase domain, and the filter coefficient calculation unit may recursively calculate a phase difference which gives a delay sum element to minimize the magnitude of the residual using the initial value set by the initial value setting unit.

(4) According to yet another aspect of the invention, the acoustic signal processing device described in the aspect (1) may further include a singular vector calculation unit configured to perform singular value decomposition on a filter matrix having at least two sets of filter coefficients as elements to calculate a singular vector, and the output signal calculation unit may be configured to calculate the output signal based on the singular vector calculated by the singular vector calculation unit and an input signal vector having the frequency domain signal as elements.

(5) According to yet another aspect of the invention, in the acoustic signal processing device described in the aspect (4), the output signal calculation unit may be configured to calculate the output signal based on a singular vector corresponding to a predefined number of singular values in a descending order from a maximum singular value in the singular vector calculated by the singular vector calculation unit.

(6) According to an aspect of the invention, there is provided an acoustic signal processing method including a first step of transforming an acoustic signal to a frequency domain signal for each channel, a second step of calculating at least two sets of filter coefficients of a filter for each section having a predefined number of frames with respect to a sampled signal obtained by sampling the frequency domain signal transformed in the first step for each frame such that the magnitude of a residual calculated based on a filter compensating for the difference in transfer characteristics between the channels of the acoustic signal is minimized, and a third step of calculating an output signal of a frequency domain based on the frequency domain signal transformed in the first step and at least two sets of filter coefficients calculated in the second step.

(7) According to an aspect of the invention, there is provided an acoustic signal processing program which causes a computer of an acoustic signal processing device to execute a first procedure for transforming an acoustic signal to a frequency domain signal for each channel, a second procedure for calculating at least two sets of filter coefficients of a filter for each section having a predefined number of frames with respect to a sampled signal obtained by sampling the frequency domain signal transformed in the first procedure for each frame such that the magnitude of a residual calculated based on a filter compensating for the difference in transfer characteristics between the channels of the acoustic signal is minimized, and a third procedure for calculating an output signal of a frequency domain based on the frequency domain signal transformed in the first procedure and at least two sets of filter coefficients calculated in the second procedure.

According to the aspect (1), (6), or (7) of the invention, it is possible to effectively reduce noise based on a small amount of prior information.

According to the aspect (2) of the invention, it is possible to easily generate prior information and to reduce the amount of processing needed to calculate a filter coefficient.

According to the aspect (3) of the invention, it is possible to avoid degeneration between channels regarding a delay sum element for reducing noise, thereby effectively reducing noise.

According to the aspect (4) of the invention, it is possible to reduce noise with respect to an acoustic signal based on a sound wave from a specific direction.

According to the aspect (5) of the invention, it is possible to significantly reduce noise from a specific direction with a smaller amount of computation.

DETAILED DESCRIPTION OF THE INVENTION (First Embodiment)

Acoustic signal processing according to this embodiment defines a delay sum of signals of a plurality of channels in a frequency domain signal obtained by transforming a multi-channel acoustic signal to a frequency domain for each channel, and calculates a delay sum element matrix having delay sum elements configured to minimize the magnitude of the residual. Then, a unitary matrix or a singular vector obtained by performing singular value decomposition on the delay sum element matrix is multiplied to an input signal vector based on the input acoustic signal to calculate an output signal vector. In the acoustic signal processing, when calculating delay sum elements, computation is recursively performed so as to give a random number to an initial value and to minimize the magnitude of the residual.

The outline of the acoustic signal processing according to this embodiment will be described referring to FIG. 1.

Figure 1:
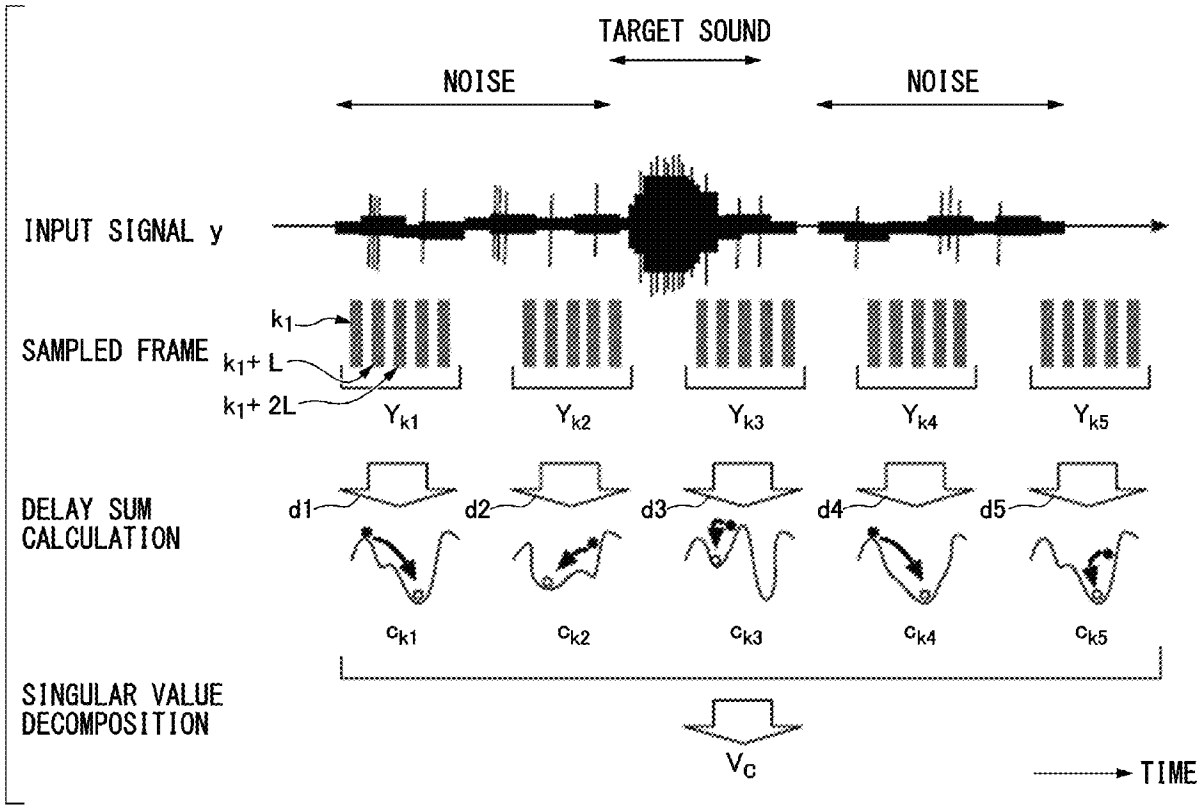
FIG. 1 is a conceptual diagram showing acoustic signal processing according to a first embodiment of the invention.

FIG. 1 is a conceptual diagram of the acoustic signal processing according to this embodiment.

In FIG. 1, the horizontal direction represents time. The uppermost row of FIG. 1 is the waveform of an input acoustic signal y of a certain channel. The number M of channels is a predefined integer (for example, 8) greater than 1. In this row, the up-down direction represents amplitude. A central portion of this waveform is a section where the amplitude of the input acoustic signal is greater than other sections, and the target sound is dominant. Sections before and after this section are sections where noise is dominant.

A second row from the uppermost row of FIG. 1 is a diagram showing the outline of sampled frames. The sampled frame is a frame which is extracted (sampled) from a frequency domain coefficient $y^k$ represented by a frequency domain for each frame k. The sampled frame is defined in advance for every number L (where L is an integer greater than 0) of frames. In the drawing, vertical bars arranged in a bunch in a left-right direction represent frequency domain coefficients $y^k$, $y^{k+L}$, . . . extracted from the frequency domain coefficient $y^k$ for each sampled frame. That is, p frequency domain coefficients $y^k$, $y^{k+L}$, . . . are extracted in order for every L frames in terms of each channel. p is a predefined integer (p=5 in the example shown in FIG. 1). Q (Q=5 in the example shown in FIG. 1) input signal matrixes $Y_{k1}$, $Y_{k2}$, . . . including p frequency domain coefficients $y^k$ as elements are generated for every section of p·L frames in terms of each channel.

Downward arrows d1 to d5 in the third row from the uppermost row of FIG. 1 represent delay sum calculation processing for calculating delay element vectors $c_{k1}$, $c_{k2}$, . . . by filter coefficient configured to minimize the magnitude of the residual based on the input signal matrixes $Y_{k1}$, $Y_{k2}$, . . . representing the start points of the arrows. The delay element vector $c_{k1}$ or the like is a nonzero vector which gives a filter representing a delay element compensating for the phase difference between channels to the input signal matrix $Y_{k1}$ or the like.

A downward arrow of the lowermost row of FIG. 1 represents performing singular value decomposition on a delay sum element matrix C obtained by integrating the calculated delay element vectors $c_{k1}$, $c_{k2}$, . . . between sampled frames to calculate a unitary matrix $V_c$. In the singular value decomposition, M' (where M' is an integer smaller than 1 or M greater than 1, for example, 5) right singular vectors $v_1$, $v_2$, . . . , and $v_{M'}$ corresponding to singular values greater than 0 or a predefined threshold value greater than 0 are calculated. The unitary matrix $V_c$ is a matrix $[v_1, v_2, \ldots, v_{M'}]$ in which the singular values corresponding to the calculated M' right singular vectors are integrated in a descending order. In this embodiment, a conjugate transpose matrix $V_c^H$ of the unitary matrix $V_c$ is multiplied to the input signal vector y having a frequency domain coefficient $y^k$ in each channel as elements, and thus an output signal vector z having an output signal $z^k$ in a frequency domain as elements is obtained. Accordingly, M-M' noise components are reduced, and signals of frequency domains from M' sound sources at different positions are extracted. In this embodiment, the processing shown in FIG. 1 is performed for each frequency.

(Configuration of Acoustic Signal Processing System)

Next, the configuration of an acoustic signal processing system 1 according to this embodiment will be described.

Figure 2:
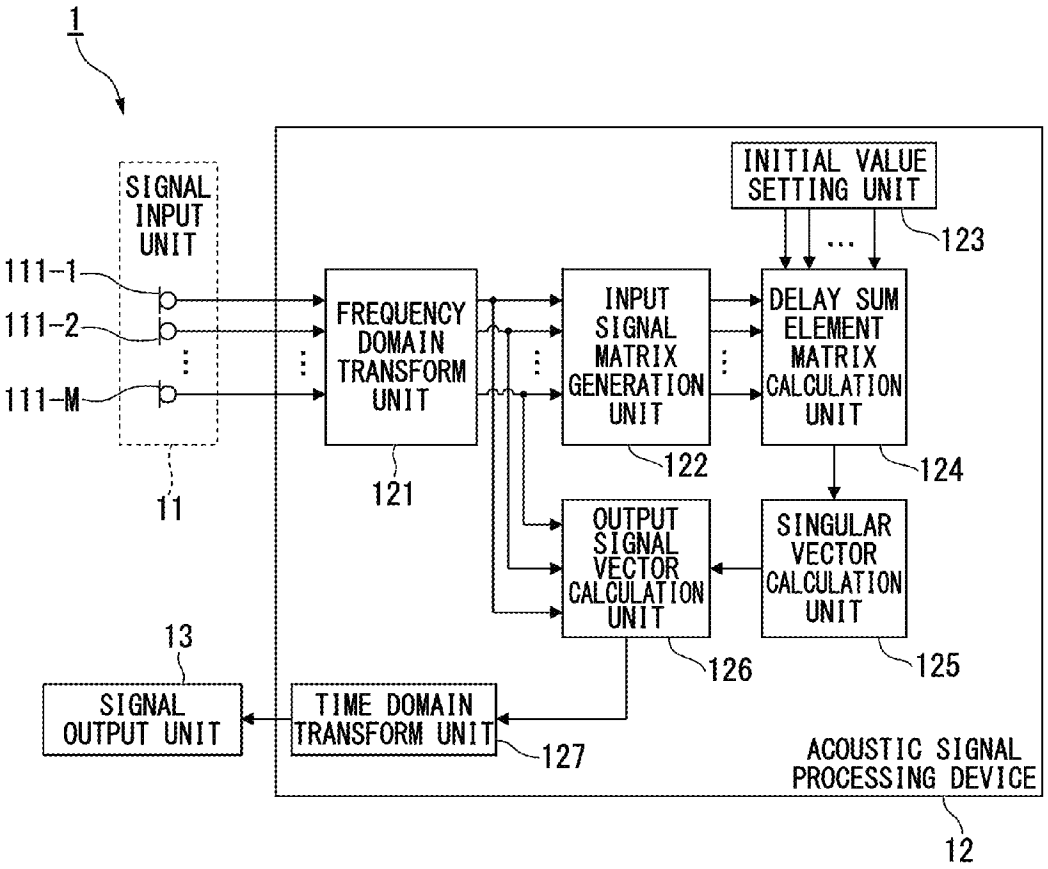
FIG. 2 is a schematic view showing the configuration of an acoustic signal processing system according to this embodiment.

FIG. 2 is a schematic view showing the configuration of the acoustic signal processing system 1 according to this embodiment.

The acoustic signal processing system 1 includes a signal input unit 11, an acoustic signal processing device 12, and a signal output unit 13. In the following description, unless explicitly stated, a vector and a matrix are represented by [ . . . ]. A vector is represented by, for example, a lowercase character [y], and a matrix is represented by, for example, an uppercase character [Y].

The signal input unit 11 acquires an M-channel acoustic signal, and outputs the acquired M-channel acoustic signal to the acoustic signal processing device 12. The signal input unit 11 includes a microphone array and a transform unit. The microphone array includes, for example, M microphones 111-1 to 111-M at different positions. The microphone 111-1 or the like converts an incoming sound wave to an analog acoustic signal as an electrical signal and outputs the analog acoustic signal. The conversion unit analog-to-digital (AD) converts the input analog acoustic signal to generate a digital acoustic signal for each channel. The conversion unit outputs the generated digital signal to the acoustic signal processing device 12 for each channel. A configuration example of a microphone array regarding the signal input unit 11 will be described. The signal input unit 11 may be an input interface which receives an M-channel acoustic signal from a remote communication device through a communication line or a data storage device as input.

The signal output unit 13 outputs the M'-channel output acoustic signal output from the acoustic signal processing device 12 outside the acoustic signal processing system 1. The signal output unit 13 is an acoustic reproduction unit which reproduces sound based on an output acoustic signal of an arbitrary channel from among the M' channels. The signal output unit 13 may be an output interface which outputs the M'-channel output acoustic signal to a data storage device or a remote communication device through a communication line.

The acoustic signal processing device 12 includes a frequency domain transform unit 121, an input signal matrix generation unit 122, an initial value setting unit 123, a delay sum element matrix calculation unit (filter coefficient calculation unit) 124, a singular vector calculation unit 125, an output signal vector calculation unit (output signal calculation unit) 126, and a time domain transform unit 127.

The frequency domain transform unit 121 transforms the M-channel acoustic signal input from the signal input unit 11 from a time domain to a frequency domain for each frame in terms of each channel to calculate a frequency domain coefficient. For example, the frequency domain transform unit 121 uses fast Fourier transform (FFT) when transforming to a frequency domain. The frequency domain transform unit 121 outputs the frequency domain coefficient calculated for each frame to the input signal matrix generation unit 122 and the output signal vector calculation unit 126. The input signal matrix generation unit 122, the initial value setting unit 123, the delay sum element matrix calculation unit 124, the singular vector calculation unit 125, and the output signal vector calculation unit 126 perform the following processing in terms of each frequency.

The input signal matrix generation unit 122 generates an input signal matrix $[Y_k]$ based on the M-channel frequency domain coefficient input from the frequency domain transform unit 121 for each frame. The input signal matrix generation unit 122 sets the number p of samples and a frame interval L in advance. The input signal matrix generation unit 122 extracts frequency domain coefficients $y_m^k$ of the input channels m (where m is an integer greater than 0 and equal to M or smaller than M) for every L frames p times. The input signal matrix generation unit 122 arranges the extracted frequency domain coefficients $y_m^k$ by the channels m in a row direction and the number p of samples in a column direction to generate an input signal matrix $[Y_k]$ having M rows and L columns in terms of each section of p·L frames. Accordingly, the input signal matrix $[Y_k]$ is expressed by Equation (1).

$$[Y_k] = \begin{bmatrix} y_1^k & y_1^{k+L} & \cdots & y_1^{k+(p-1)L} \\ y_2^k & y_2^{k+L} & \cdots & y_2^{k+(p-1)L} \\ \vdots & \vdots & \ddots & \vdots \\ y_M^k & y_M^{k+L} & \cdots & y_M^{k+(p-1)L} \end{bmatrix} \tag{1}$$

The input signal matrix generation unit 122 outputs the generated input signal matrix $[Y_k]$ of each section to the delay sum element matrix calculation unit 124 in terms of each section.

The input signal matrix generation unit 122 may extract the frequency domain coefficients $y_m^k$ for each frame, instead of extracting the frequency domain coefficients $y_m^k$ for every frames L. As described above, when the frequency domain coefficients $y_m^k$ are extracted for every frames L, a more stable solution as a solution of a delay element vector described below can be obtained using the frequency domain coefficients $y_m^k$ acquired at different times as much as possible.

The initial value setting unit 123 has a predefined number Q of sections and sets the initial values of Q delay element vectors $[c_k]$. The delay element vector $[c_k]$ is a vector which has the phase difference $\theta_{m,k}$ between a predefined channel (for example, channel 1) and another channel m in a frame k as elements. In general, the delay element vector $[c_k]$ is expressed by Equation (2).

$$[c_k]=[1 e^{j\omega\theta_{2,k}} e^{j\omega\theta_{3,k}} \ldots e^{j\omega\theta_{M,k}}] \tag{2}$$

In Equation (2), ω is an angular frequency. Accordingly, there are (M−1)·Q initial values of the phase difference $\theta_{m,k}$.

The initial value setting unit 123 sets the (M−1)·Q initial values $\theta_{m,k}$ as a random number in a range of [−π,π]. When there is no information regarding a desired phase angle in advance, while a uniform random number can be used as the random number, in this case, each element value (excluding the channel 1) of the delay element vector $[c_k]$ becomes a random number which is distributed uniformly in a direction of a phase angle on a unit circle, that is, a uniform random number of a phase angle region.

The initial value setting unit 123 outputs the set initial values of Q delay element vectors $[c_k]$ to the delay sum element matrix calculation unit 124.

The delay sum element matrix calculation unit 124 calculates the delay element vector $[c_k]$ based on the input signal matrix $[Y_k]$ for each section input from the input signal matrix generation unit 122 and the initial value of the delay element vector $[c_k]$ for each section input from the initial value setting unit 123. The delay sum element matrix calculation unit 124 calculates the delay element vector $[c_k]$ such that a norm $|[\epsilon_k]|$ as the magnitude of a residual vector $[\epsilon_k]$ is minimized. The residual vector $[\epsilon_k]$ is a vector which is obtained by applying a delay sum filter having the delay element vector $[c_k]$ to the input signal matrix $[Y_k]$. That is, the delay sum element matrix calculation unit 124 obtains the delay element vector $[c_k]$ corresponding to a blind zone in a direction in which the magnitude of the delay sum becomes zero. In other words, the delay element vector $[c_k]$ is a vector which has a blind zone control beamformer as an element. The delay element vector $[c_k]$ can be regarded as a filter coefficient group having a coefficient to be multiplied to the frequency domain coefficient $y_m^k$ of each channel.

In order to calculate the delay element vector $[c_k]$ in which the norm $|[\epsilon_k]|$ is minimized, for example, the delay sum element matrix calculation unit 124 uses a known method, such as a least mean square method. For example, as expressed by Equation (3), the delay sum element matrix calculation unit 124 recursively calculates a phase $\theta_{m,k}(t+1)$ at the next iteration t+1 based on a phase $\theta_{m,k}(t)$ at a current iteration t using a least mean square method.

$$[\theta_k(t+1)] = [\theta_k(t)] - \alpha \frac{\partial}{\partial [\theta_k]} |[\varepsilon_k]|^2 \tag{3}$$

In Equation (3), $[\theta_k(t+1)]$ is a vector which has the phase $\theta_{m,k}$ of each channel regarding the frame k at the iteration t+1 as an element. $\alpha$ is a predefined positive real number (for example, 0.00012). A method of calculating the phase $\theta_{m,k}$ (t+1) using Equation (3) is called a gradient method.

The delay sum element matrix calculation unit 124 arranges the Q delay element vectors $[c_k]$ calculated for the respective sections in order of the sections in the row direction to generate a delay sum element matrix [C] having Q rows and M columns.

The delay sum element matrix calculation unit 124 outputs the Q delay sum element matrixes [C] generated for the respective sections to the singular vector calculation unit 125.

As described above, in the initial value setting unit 123, a random number is given to the initial value of the phase difference $\theta_{m,k}$, and the initial values of a plurality of delay element vectors $[c_k]$ are obtained based on the given initial value of the phase difference $\theta_{m,k}$. The delay sum element matrix calculation unit 124 calculates a candidate of a solution so as to minimize a residual for each of a plurality of delay element vectors $[c_k]$. The input signal matrix $[Y_k]$ which is used to calculate these delay element vectors $[c_k]$ is based on an acoustic signal input for each section at different time. In this embodiment, a processing method which gives a random number to an initial value in the above-described manner and recursively calculates a phase difference is called a Monte Carlo parameter search method.

In this manner, a random number is given to an initial value to generate a plurality of delay element vectors $[c_k]$ without degeneration, and thus a solution enough to represent a vector space suppressing noise in a specific direction is obtained. While noise is produced steadily, target sound, such as human speech, tends to be produced temporarily. As described above, the delay element vector $[c_k]$ calculated over a plurality of sections is primarily calculated in a section where only noise is reached, and is comparatively less calculated in a section where both target sound and noise are reached. In other words, only a small portion of the delay element vector $[c_k]$ suppresses the target sound.

The singular vector calculation unit 125 performs singular value decomposition on the delay sum element matrix[C] input from the delay sum element matrix calculation unit 124 for each of the Q sections to calculate a singular value matrix [Σ] having Q rows and M columns. Singular value decomposition is an operation which calculates a unitary matrix U having Q rows and Q columns and a unitary matrix V having M rows and M columns so as to satisfy the relationship of Equation (4), in addition to the singular value matrix[Σ].

$$[C]=[U][\Sigma][V]^H \tag{4}$$

In Equation (4), $[V]^H$ is a conjugate transpose matrix of the matrix [V]. The matrix [V] has M right singular vectors $[v_1], \ldots,$ and $[v_M]$ corresponding to singular values $\sigma_1, \ldots,$ and $\sigma_M$ in each column. Indexes 1, . . . , and M representing an order are in a decreasing order of the singular values $\sigma_1, \ldots,$ and $\sigma_M$. The singular vector calculation unit 125 selects M' (where M' is a predefined integer equal to M or smaller than M and greater than 0) right singular vectors $[v_1], \ldots,$ and $[v_{M'}]$ from among the M right singular vectors. Accordingly, a singular vector corresponding to a singular value equal to zero or close to zero is excluded. The singular vector calculation unit 125 may select M' right singular vectors $[v_1], \ldots,$ and $[v_{M'}]$ corresponding to a singular value greater than a predefined threshold value $\sigma_{th}$ from among the M right singular vectors.

The singular vector calculation unit 125 arranges the selected M' right singular vectors $[v_1], \ldots,$ and $[v_{M'}]$ in the column direction in a descending order of the singular values to generate a matrix $[V_c]$ having M rows and M' columns, and generates a conjugate transpose matrix $[V_c]^H$ of the generated matrix $[V_c]$. The singular vector calculation unit 125 outputs the generated conjugate transpose matrix $[V_c]^H$ to the output signal vector calculation unit 126 for each of the Q sections.

The output signal vector calculation unit 126 generates an input signal vector $[y_k]$ based on the M-channel frequency domain coefficient input from the frequency domain transform unit 121 for each frame. The output signal vector calculation unit 126 arranges the input frequency domain coefficient $y_m^k$ for each frame k of each channel m to generate the input signal vector $[y_k]$ having M columns. The output signal vector calculation unit 126 multiplies the conjugate transpose matrix $[V_c]^H$ having M' rows and M columns input from the singular vector calculation unit 125 to the generated input signal vector $[y_k]$ having M columns to calculate an output signal vector $[z_k]$ having M' columns. A component of each column represents an output frequency domain coefficient for each channel. That is, each of the right singular vectors $[v_1], \ldots,$ and $[v_{M'}]$ can be regarded as a filter coefficient for the input signal vector $[y_k]$. The output signal vector calculation unit 126 outputs the calculated output signal vector $[z_k]$ to the time domain transform unit 127.

The output signal vector calculation unit 126 may multiply one of vectors $[v_1]^H, \ldots,$ and $[v_{M'}]^H$ obtained by transposing the right singular vectors $[v_1], \ldots,$ and $[v_{M'}]$ to the input signal vector $[y_k]$ to calculate an output frequency domain coefficient $Z_k$ (scalar quantity). The output signal vector calculation unit 126 outputs the calculated output frequency domain coefficient to the time domain transform unit 127. As a vector which is multiplied to the input signal vector $[y_k]$, a vector $[v_1]^H$ corresponding to the maximum singular value $\sigma_1$ is used. The conjugate transpose matrix $[V_C]^H$ is a matrix which has vectors $[v_1]^H$, . . . , and $[v_{M'}]^H$ including components configured to minimize a noise component as elements. Since the singular values $\sigma_1$, . . . , and $\sigma_{M'}$ represent how much the respective vectors $[v_1]^H$, . . . , and $[v_{M'}]^H$ contribute to the delay sum element matrix, and a vector $[v_1]^H$ having a maximum ratio of components configured to minimize a noise component is used, thereby effectively suppressing noise.

The time domain transform unit 127 transforms the output frequency domain coefficient of the output signal vector $[z_k]$ input from the output signal vector calculation unit 126 from a frequency domain to a time domain for each channel to calculate an output acoustic signal of a time domain. For example, the time domain transform unit 127 uses inverse fast Fourier transform (IFFT) when transforming to a time domain. The time domain transform unit 127 outputs the calculated output acoustic signal for each channel to the signal output unit 13.

(Acoustic Signal Processing)

Next, the acoustic signal processing according to this embodiment will be described.

Figure 3:
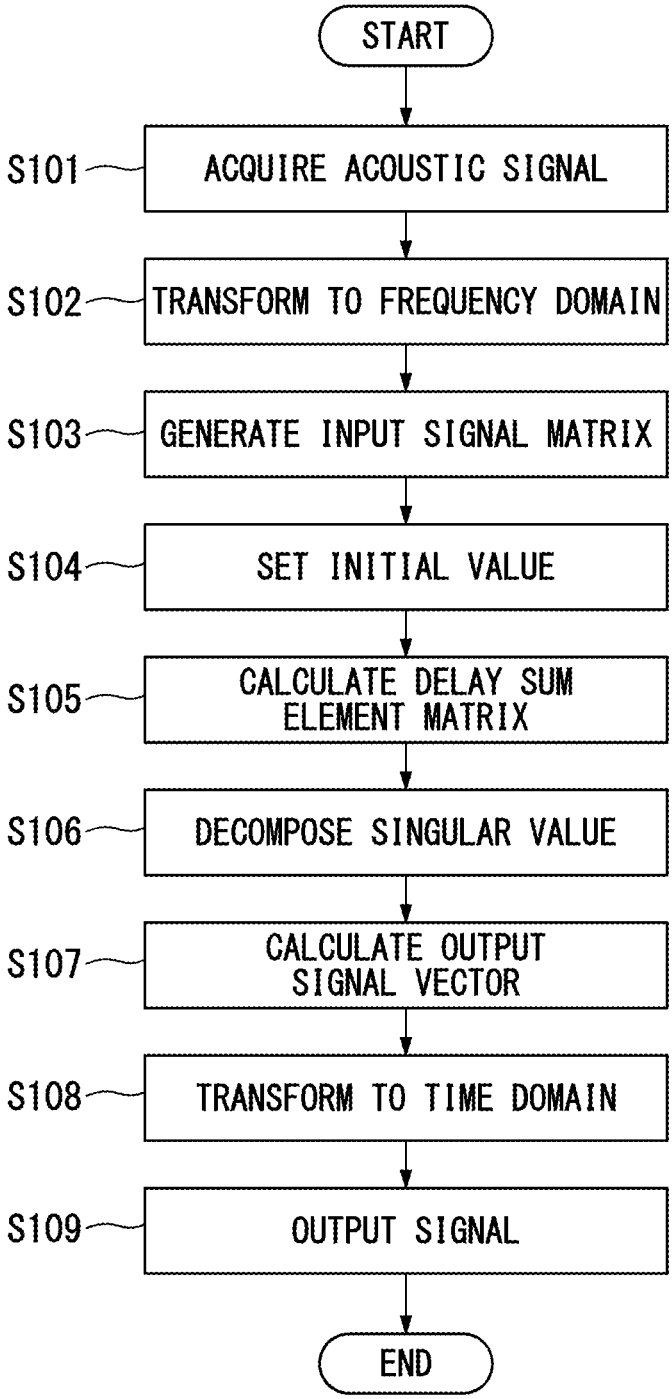
FIG. 3 is a flowchart showing acoustic signal processing according to this embodiment.

FIG. 3 is a flowchart showing the acoustic signal processing according to this embodiment.

(Step S101) The signal input unit 11 acquires the M-channel acoustic signal, and outputs the acquired M-channel acoustic signal to the acoustic signal processing device 12. Thereafter, the process progresses to Step S102.

(Step S102) The frequency domain transform unit 121 transforms the M-channel acoustic signal input from the signal input unit 11 from a time domain to a frequency domain for each frame in terms of each channel to calculate the frequency domain coefficient. The frequency domain transform unit 121 outputs the calculated frequency domain coefficient to the input signal matrix generation unit 122 and the output signal vector calculation unit 126. Thereafter, the process progresses to Step S103.

(Step S103) The input signal matrix generation unit 122 generates the input signal matrix $[Y_k]$ in terms of each section of p·L frames based on the M-channel frequency domain coefficient input from the frequency domain transform unit 121 for each frame. The input signal matrix generation unit 122 outputs the generated input signal matrix $[Y_k]$ for each section to the delay sum element matrix calculation unit 124. Thereafter, the process progresses to Step S104.

(Step S104) The initial value setting unit 123 sets the (M−1)·Q initial values $\theta_{m,k}$ in a range of $[-\pi,\pi]$ as a random number, and sets the initial values of the Q delay element vectors $[c_k]$ based on the (M−1) initial values $\theta_{m,k}$. The initial value setting unit 123 outputs the set initial values the Q delay element vectors $[c_k]$ to the delay sum element matrix calculation unit 124. Thereafter, the process progresses to Step S105.

(Step S105) The delay sum element matrix calculation unit 124 calculates the delay element vector $[c_k]$ based on the input signal matrix $[Y_k]$ input from the input signal matrix generation unit 122 and the initial value of the delay element vector $[c_k]$ for each section input from the initial value setting unit 123. The delay sum element matrix calculation unit 124 calculates the delay element vector $[c_k]$ such that the norm $|[\epsilon_k]|$ of the residual vector $[\epsilon_k]$ is minimized. The delay sum element matrix calculation unit 124 arranges the Q delay element vectors $[c_k]$ in order in the row direction to generate the delay sum element matrix [C]. The delay sum element matrix calculation unit 124 outputs the generated delay sum element matrix [C] to the singular vector calculation unit 125. Thereafter, the process progresses to Step S106.

(Step S106) The singular vector calculation unit 125 performs singular value decomposition on the delay sum element matrix [C] input from the delay sum element matrix calculation unit 124, and calculates the singular value matrix [Σ], the unitary matrix U, and the unitary matrix V. The singular vector calculation unit 125 arranges the M' right singular vectors $[v_1]$, . . . , and $[v_{M'}]$ selected from the unitary matrix V in a descending order of the singular values $\sigma_1$, . . . , and $\sigma_M$ in the column direction to generate the matrix $[V_c]$. The singular vector calculation unit 125 outputs the conjugate transpose matrix $[V_c]^H$ of the generated matrix $[V_c]$ to the output signal vector calculation unit 126. Thereafter, the process progresses to Step S107.

(Step S107) The output signal vector calculation unit 126 generates the input signal vector $[y_k]$ based on the M-channel frequency domain coefficient input from the frequency domain transform unit 121 for each frame. The output signal vector calculation unit 126 multiplies the conjugate transpose matrix $[V_c]_H$ having M' rows and M columns input from the singular vector calculation unit 125 to the generated input signal vector $[y_k]$ to calculate the output signal vector $[z_k]$ having M' columns. The output signal vector calculation unit 126 outputs the calculated output signal vector $[z_k]$ to the time domain transform unit 127. Thereafter, the process progresses to Step S108.

(Step S108) The time domain transform unit 127 transforms the output frequency domain coefficient of the output signal vector $[z_k]$ input from the output signal vector calculation unit 126 from a frequency domain to a time domain for each channel in terms of each frame to calculate an output acoustic signal of a time domain. The time domain transform unit 127 outputs the calculated acoustic signal for each channel to the signal output unit 13.

Thereafter, the process progresses to Step S109.

(Step S109) The signal output unit 13 outputs the M'-channel acoustic signal output from the acoustic signal processing device 12 outside the acoustic signal processing system 1. Thereafter, the process ends.

As described above, in this embodiment, an acoustic signal is converted to a frequency domain signal for each channel. In this embodiment, for a sampled signal obtained by sampling the transformed frequency domain signal for each frame, at least two sets of delay element vectors are calculated for each section of a predefined number of frames based on a filter compensating for the difference in transfer characteristic between the channels of the acoustic signal expressed by a vector (delay element vector) having delay elements arranged therein such that the calculated residual is minimized. In this embodiment, an output signal of a frequency domain is calculated based on the transformed frequency domain signal and at least two sets of calculated filter coefficients. Accordingly, in this embodiment, since the filter configured to minimize noise from a specific direction is calculated, noise from the direction is suppressed on the calculated filter. Accordingly, it is possible to effectively reduce noise based on a small amount of prior information.

In this embodiment, the difference in the transfer characteristic between the channels is the phase difference, the filter is the delay sum based on the phase difference, and the random number in the phase region as the initial value of the phase difference for each channel and each predefined time. Accordingly, the initial value of the phase difference as prior information is easily generated, thereby reducing the amount of processing needed to calculate the filter coefficient.

In this embodiment, singular value decomposition is performed on the delay sum element matrix having at least two sets of delay element vectors as elements to calculate a singular vector, and an output signal is calculated based on an input signal vector having the calculated singular vector and the frequency domain signal as elements. In this embodiment, since the delay sum element matrix which is subjected to singular value decomposition has an element vector corresponding to a delay sum element in which a noise component of the input signal vector is minimized, the noise component of the calculated singular vector and the input signal vector are substantially perpendicular to each other. For this reason, according to this embodiment, it is possible to reduce noise for the acoustic signal based on a sound wave from a specific direction.

In this embodiment, the output signal is calculated based on a singular vector corresponding to a predefined number of singular values in a descending order from the maximum singular value from the calculated singular vector. Since a singular value represents the ratio of components configured to minimize a noise component, according to this embodiment, it is possible to reduce noise from a specific direction with a smaller amount of computation.

(Second Embodiment)

Next, a second embodiment of the invention will be described.

The configuration of an acoustic signal processing system 2 according to this embodiment will be described while the same configuration and processing are represented by the same reference numerals.

Figure 4:
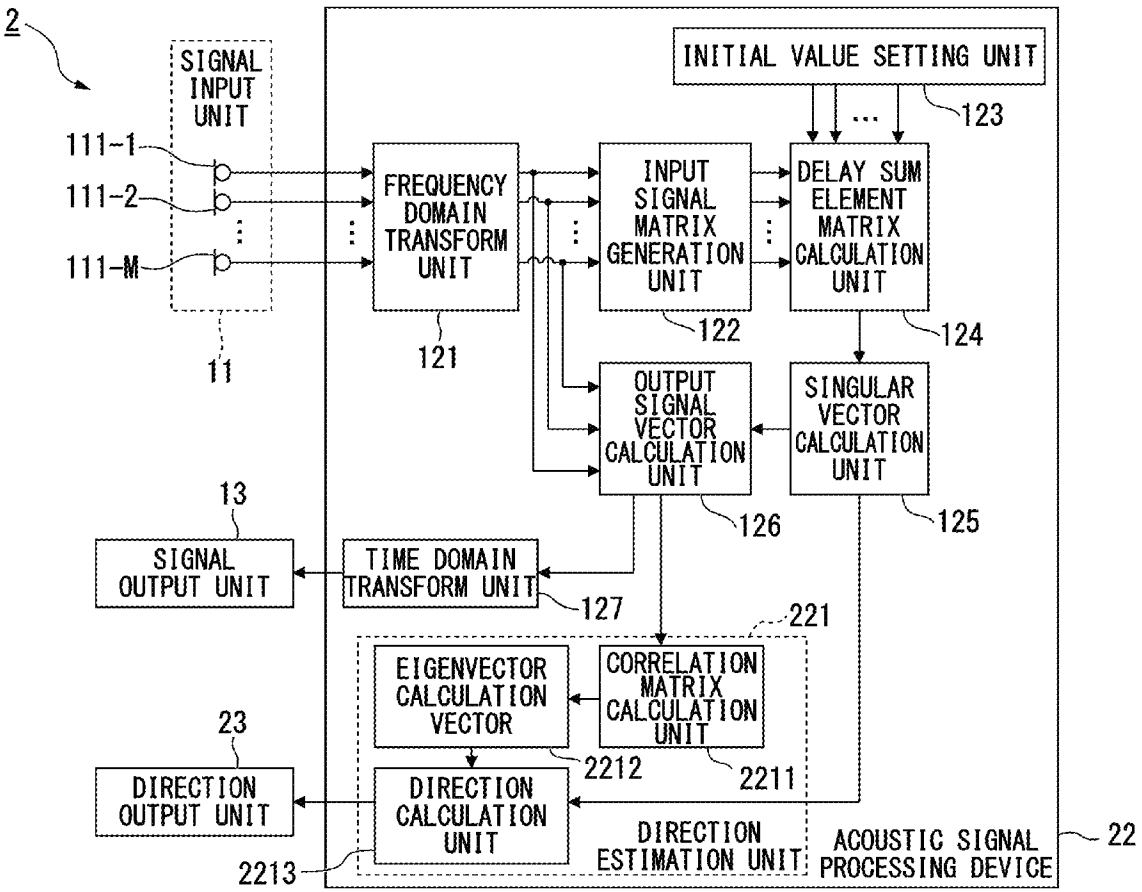
FIG. 4 is a schematic view showing the configuration of an acoustic signal processing system according to a second embodiment of the invention.

FIG. 4 is a schematic view showing the configuration of the acoustic signal processing system 2 according to this embodiment.

The acoustic signal processing system 2 includes a signal input unit 11, an acoustic signal processing device 22, a signal output unit 13, and a direction output unit 23.

The acoustic signal processing device 22 includes a direction estimation unit 221 in addition to a frequency domain transform unit 121, an input signal matrix generation unit 122, an initial value setting unit 123, a delay sum element matrix calculation unit 124, a singular vector calculation unit 125, an output signal vector calculation unit 126, and a time domain transform unit 127.

The direction estimation unit 221 estimates a direction of a sound source based on the output signal vector $[z_k]$ output from the output signal vector calculation unit 126, and outputs a sound source direction signal representing the estimated direction of the sound source to the direction output unit 23. For example, the direction estimation unit 221 uses a multiple signal classification (MUSIC) method when estimating a direction of a sound source. The MUSIC method is a method which estimates an incoming direction of a sound wave using the fact that a noise portion space and a signal portion space are perpendicular to each other.

When a MUSIC method is used, the direction estimation unit 221 includes a correlation matrix calculation unit 2211, an eigenvector calculation unit 2212, and a direction calculation unit 2213. Unless explicitly stated, the correlation matrix calculation unit 2211, the eigenvector calculation unit 2212, and the direction calculation unit 2213 perform processing for each frequency.

The output signal vector calculation unit 126 also outputs the output signal vector $[z_k]$ to the correlation matrix calculation unit 2211. The correlation matrix calculation unit 2211 calculates a correlation matrix $[R_{zz}]$ having M' rows and M' columns based on the output signal vector $[z_k]$ using Equation (5).

$$[R_{zz}]=E([z_k][z_k]^H) \tag{5}$$

That is, the correlation matrix $[R_{zz}]$ is a matrix which has a time average value over a predefined number of frames for a product of output signal values between channels as elements. The correlation matrix calculation unit 2211 outputs the calculated correlation matrix $[R_{zz}]$ to the eigenvector calculation unit 2212.

The eigenvector calculation unit 2212 diagonalizes the correlation matrix $[R_{zz}]$ input from the correlation matrix calculation unit 2211 to calculate M' eigenvectors $[f_1], \ldots,$ and $[f_{M'}]$. The order of the eigenvectors $[f_1], \ldots,$ and $[f_{M'}]$ is a descending order of corresponding eigenvalues $\lambda_1, \ldots,$ and $\lambda_{M'}$. The eigenvector calculation unit 2212 outputs the calculated eigenvectors $[f_1], \ldots,$ and $[f_{M'}]$ to the direction calculation unit 2213.

The eigenvectors $[f_1], \ldots,$ and $[f_{M'}]$ are input from the eigenvector calculation unit 2212 to the direction calculation unit 2213, and the conjugate transpose matrix $[V_C]^H$ is input from the singular vector calculation unit 125 to the direction calculation unit 2213. The direction calculation unit 2213 generates a steering vector $[a(\phi)]$. The steering vector $[a(\phi)]$ is a vector which has, as elements, coefficients representing transfer characteristics of sound waves from sound sources in a direction $\phi$ from representative points (for example, center points) of the microphones 111-1 to 111-M of the signal input unit 11 to the microphones 111-1 to 111-M. For example, the steering vector $[a(\phi)]$ is $[a_1(\phi), \ldots, a_M(\phi)]^H$. In this embodiment, for example, coefficients $a_1(\phi)$ to $a_M(\phi)$ represent the transfer characteristics from the sound sources in the direction $\phi$ to the microphones 111-1 to 111-M. For this reason, the direction calculation unit 2213 includes a storage unit which stores the direction $\phi$ in association with transfer functions $a_1(\phi), \ldots,$ and $a_M(\phi)$ in advance.

The coefficients $a_1(\phi)$ to $a_M(\phi)$ may be coefficients which have the magnitude of 1 representing the phase difference between the channels for a sound wave from the direction $\phi$. For example, the microphones 111-1 to 111-M are arranged in a straight line, and when the direction $\phi$ is an angle based on the arrangement direction, the coefficient $a_m(\phi)$ is $\exp(-j\omega d_{m,1} \sin\phi)$. $d_{m,1}$ is the distance between the microphone **111-*m* and the microphone 111-1. Accordingly, if the inter-microphone distance $d_{m,1}$ is set in advance, the direction calculation unit 2213** can calculate an arbitrary steering vector $[a(\phi)]$.

The direction calculation unit 2213 calculates a MUSIC spectrum $P(\phi)$ for each frequency using Equation (6) based on the calculated steering vector $[a(\phi)]$, the input conjugate transpose matrix $[V_c]^H$, and the eigenvectors $[f_1], \ldots,$ and $[f_{M'}]$.

$$P(\phi) = \frac{1}{\sum_{m=M''+1}^{M'} |[a(\phi)]^H [V_C]^H [f_m]|} \tag{6}$$

In Equation (6), M" is an integer which represents a maximum value of a sound wave to be estimated, and an integer greater than 0 and smaller than M'. Accordingly, the direction calculation unit 2213 averages the calculated MUSIC spectrum $P(\phi)$ within a frequency band set in advance to calculate an average MUSIC spectrum $P_{avg}(\phi)$. As the frequency band set in advance, a frequency band in which the sound pressure of speech of a speaker is great and the sound pressure of noise is small may be used.

For example, a frequency band is 0.5 to 2.8 kHz.

The direction calculation unit 2213 may expand the calculated MUSIC spectrum $P(\phi)$ to a broadband signal to calculate the average MUSIC spectrum $P_{avg}(\phi)$. For this reason, the direction calculation unit 2213 selects a frequency $\omega$ having a S/N ratio higher than a threshold value set in advance (that is, less noise) based on the output signal vector input from the output signal vector calculation unit 126.

The direction calculation unit 2213 performs weighting addition to the square root of the maximum eigenvalue $\lambda_1$ calculated by the eigenvector calculation unit 2212 and the MUSIC spectrum P(ϕ) at the selected frequency ω using Equation (7) to calculate a broadband MUSIC spectrum $P_{avg}(\phi)$.

$$P_{avg}(\phi) = \frac{1}{|\Omega|}\sum_{\omega\in\Omega}\sqrt{\lambda_{max}(\omega)}\,P_{\omega}(\phi) \tag{7}$$

In Equation (4), Ω represents a set of frequencies ω, and |Ω| is the number of elements of the set Ω, and k represents an index which represents a frequency band. With weighting addition, a component by the MUSIC spectrum $P_{avg}(\phi)$ in the frequency band ω is strongly reflected in the average MUSIC spectrum $P_{avg}(\phi)$.

The direction calculation unit 2213 detects the peak value (maximum value) of the average MUSIC spectrum $P_{avg}(\phi)$, and selects a maximum of M" directions ϕ corresponding to the detected peak value. The selected ϕ is estimated as a sound source direction.

The direction calculation unit 2213 outputs direction information representing the selected direction ϕ to the direction output unit 23.

The direction output unit 23 outputs the direction information input from the direction calculation unit 2213 outside the acoustic signal processing system 2. The direction output unit 23 may be an output interface which outputs the direction information to a data storage device or a remote communication device through a communication line.

(Acoustic Signal Processing)

Next, the acoustic signal processing according to this embodiment will be described.

Figure 5:
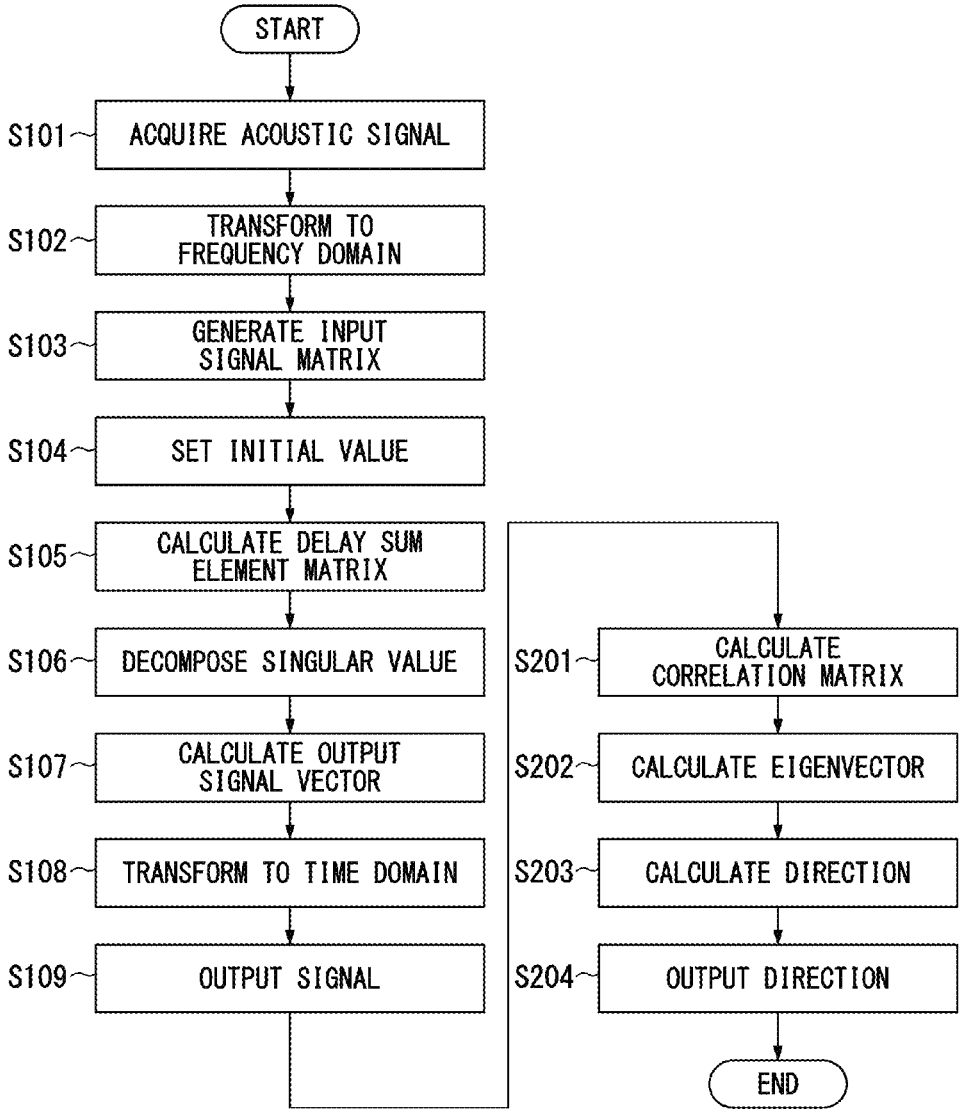
FIG. 5 is a flowchart showing acoustic signal processing according to this embodiment.

FIG. 5 is a flowchart showing the acoustic signal processing according to this embodiment.

The acoustic signal processing shown in FIG. 5 further includes Steps S201 to S204 in addition to the Steps S101 to S109 shown in FIG. 3. In this embodiment, while Steps S201 to S204 may be executed after Steps S108 and S109 are executed, the invention is not limited thereto. In this embodiment, Steps S108 and S109 and Steps S201 to S204 may be executed in parallel, or Steps S108 and S109 may be executed after Steps S201 to S204. Hereinafter, for example, a case where Steps S201 to S204 are executed after Steps S108 and S109 will be described.

(Step S201) The correlation matrix calculation unit 2211 calculates a correlation matrix $[R_{zz}]$ having M' rows and M' columns using Equation (5) based on the output signal vector $[z_k]$ calculated by the output signal vector calculation unit. The correlation matrix calculation unit 2211 outputs the calculated correlation matrix $[R_{zz}]$ to the eigenvector calculation unit 2212. Thereafter, the process progresses to Step S202.

(Step S202) The eigenvector calculation unit 2212 diagonalizes the correlation matrix $[R_{zz}]$ input from the correlation matrix calculation unit 2211 to calculate M' eigenvectors $[f_1], \ldots,$ and $[f_{M'}]$. The eigenvector calculation unit 2212 outputs the calculated eigenvectors $[f_1], \ldots,$ and $[f_{M'}]$ to the direction calculation unit 2213. Thereafter, the process progresses to Step S203.

(Step S203) The direction calculation unit 2213 generates a steering vector [a(ϕ)]. The direction calculation unit 2213 calculates a MUSIC spectrum P(ϕ) for each frequency using Equation (6) based on the generated steering vector [a(ϕ)], the eigenvectors $[f_1], \ldots,$ and $[f_{M'}]$ input from the eigenvector calculation unit 2212, and the conjugate transpose matrix $[V_c]^H$ input from the singular vector calculation unit 125. The direction calculation unit 2213 averages the calculated MUSIC spectrum P(ϕ) within a frequency band set in advance to calculate an average MUSIC spectrum $P_{avg}(\phi)$.

The direction calculation unit 2213 detects the peak value of the average MUSIC spectrum $P_{avg}(\phi)$, defines a direction ϕ corresponding to the detected peak value, and outputs direction information representing the defined direction ϕ to the direction output unit 23. Thereafter, the process progresses to Step S204.

(Step S204) The direction output unit 23 outputs the direction information input from the direction calculation unit 2213 outside the acoustic signal processing system 2. Thereafter, the process ends.

(Experimental Example)

Next, an experimental example which is carried out by operating the acoustic signal processing system 2 according to this embodiment will be described. In the experiment, a single noise source 31 arranged in an experimental laboratory emits noise, and a single sound source 32 emits target sound. An acoustic signal in which recorded noise and target sound are mixed is input from the signal input unit 11, and the acoustic signal processing system 2 is operated.

An arrangement example of the signal input unit 11, the noise source 31, and the sound source 32 will be described.

Figure 6:
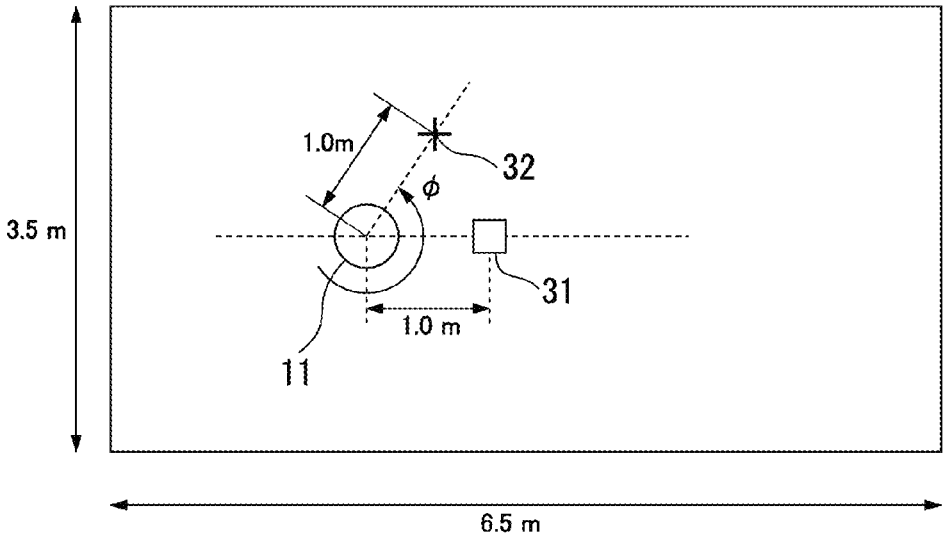
FIG. 6 is a plan view showing an arrangement example of a signal input unit, a noise source, and a sound source.

FIG. 6 is a plan view showing an arrangement example of the signal input unit 11, the noise source 31, and the sound source 32.

A horizontally long rectangle shown in FIG. 6 represents an inner wall surface of the experimental laboratory. The size of the experimental laboratory is a rectangular parallelepiped of 3.5 m vertical, 6.5 m horizontal, and 2.7 m height. The noise source 31 is substantially arranged in the central portion of the experimental laboratory. The center point of the signal input unit 11 is arranged at a position away from the noise source 31 by 0.1 m at the left end of the experimental laboratory. The signal input unit 11 is a microphone array including eight microphones. In FIG. 6, the direction ϕ is expressed by an azimuth angle based on an opposite direction to the direction from the center point of the signal input unit 11 to the noise source. The direction of the noise source is 180°. The sound source 32 is arranged at a position away from the center point of the signal input unit 11 by 1.0 m in the direction ϕ different from the noise source.

Next, the configuration of the signal input unit 11 used in the experiment will be described.

Figure 7:
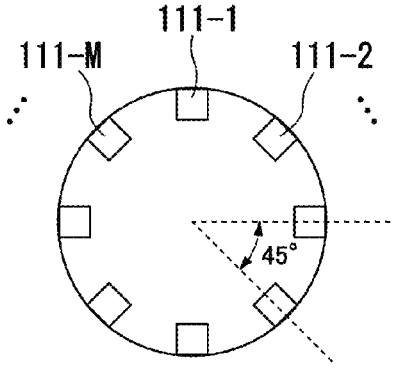
FIG. 7 is a schematic view showing a configuration example of a signal input unit.

FIG. 7 is a schematic view showing a configuration example of the signal input unit 11.

The signal input unit 11 has eight non-directional microphones 111-1 to 111-M at a regular interval (45°) on a circumference having a diameter of 0.3 m centering around the center point on a horizontal surface.

Next, an example of noise used in the experiment will be described.

Figure 8:
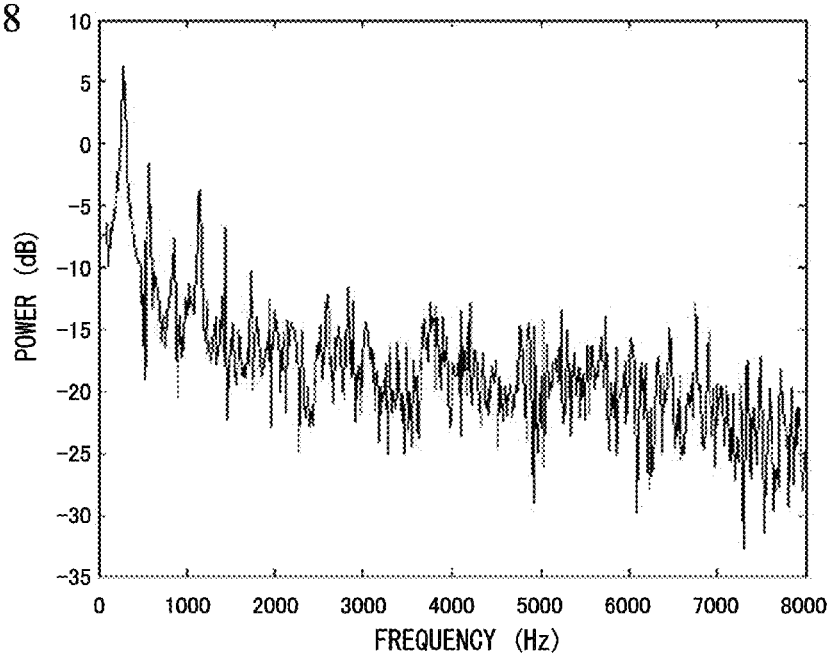
FIG. 8 is a diagram showing an example of a spectrum of noise used in an experiment.

FIG. 8 is a diagram showing an example of a spectrum of noise used in the experiment.

In FIG. 8, the horizontal axis represents a frequency, and the vertical axis represents power. Noise used in the experiment has a power peak at about 250 Hz, and at a frequency higher than a frequency regarding the peak, as the frequency becomes higher, power is monotonically lowered. Noise primarily includes a low-frequency component at a frequency lower than about 600 Hz.

Next, an example of target sound used in the experiment will be described.

Figure 9:
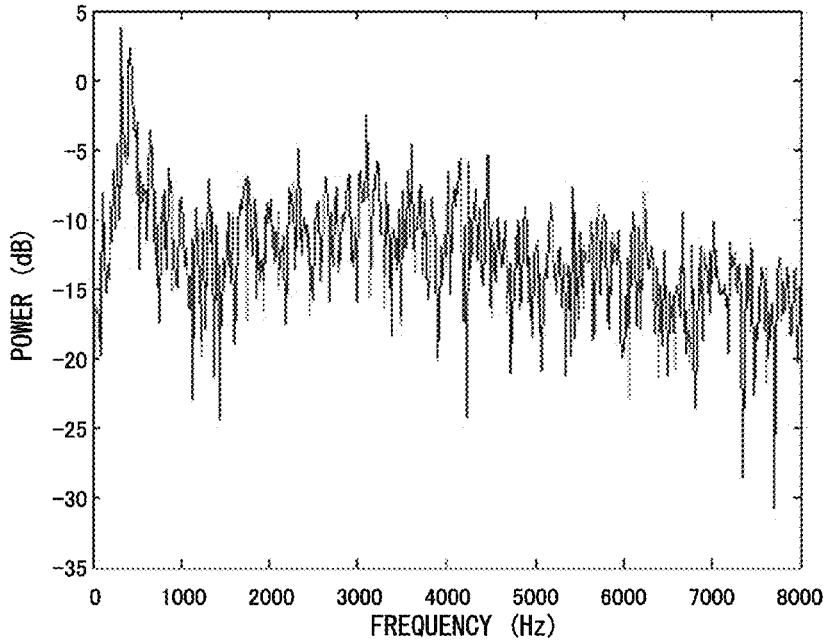
FIG. 9 is a diagram showing an example of a spectrum of target sound used in an experiment.

FIG. 9 is a diagram showing an example of a spectrum of target sound used in the experiment.

In FIG. 9, the horizontal axis represents a frequency, and the vertical axis represents power. Target sound used in the experiment has a power peak at about 350 Hz. At a frequency higher than a frequency regarding the peak, while power tends to be lowered as the frequency becomes high roughly, it is not always true that power is monotonically lowered. Target sound sued in the experiment has a smooth bottom (minimum) and a peak (maximum) at about 1300 Hz and 3000 Hz in a general form of power. Since music is used as target sound used in the experiment, the spectrum varies over time.

Other conditions in the experiment are as follows. The number of FFT points in the frequency domain transform unit 121 and the time domain transform unit 127 is 1024. The number of FFT points is the number of samples of a signal included in one frame. A shift length, that is, a shift of a sample position between adjacent frames regarding a head sample of each frame is 512. In the frequency domain transform unit 121, a signal of a timed domain generated by applying a Blackman window as a window function to an acoustic signal extracted for each frame is transformed to a frequency domain coefficient.

(Change Example of Phase Difference)

Next, an example of the phase difference $\theta_{m,k}(t)$ in the frame k calculated by the delay sum element matrix calculation unit 124 will be described. In the following description, the indexes k and t representing a frame and iteration in the phase difference $\theta_{m,k}(t)$ are omitted, the phase difference in terms of the channel m is expressed by $\theta_m$ (where m is an integer greater than 1 and equal to 8 or smaller than 8). While the phase difference from the channel 1 as reference is represented as $\theta_1$, since $\theta_1$ is constantly 0 from the definition, and the phase of the channel 1 can be taken arbitrarily, if $\theta_1$ is defined as 0, $\theta_m$ may be simply called a phase.

Figure 10:
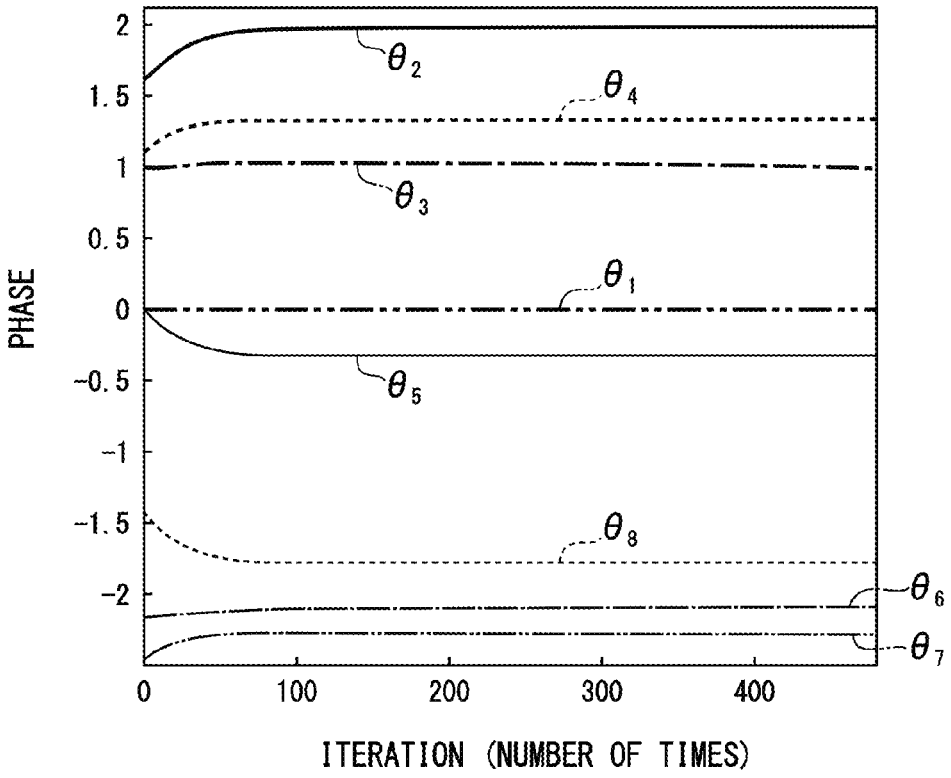
FIG. 10 is a diagram showing an example of change in phase by iteration.

FIG. 10 is a diagram showing an example of change in the phase difference $\theta_m$ by the iteration t.

In FIG. 10, the vertical axis represents a phase difference (radian), and the horizontal axis represents iteration (number of times).

In this embodiment, as described above, although the initial values (that is, t=0) of the phase differences $\theta_2, \ldots,$ and $\theta_8$ are random values, if the iteration increases, the initial values monotonically converge on given values.

If the iteration t exceeds 90 times, the phase differences $\theta_2, \ldots,$ and $\theta_8$ respectively reach given values.

(Example of Singular Value)

Next, an example of the singular value m calculated by the singular vector calculation unit 125 will be described.

Figure 11:
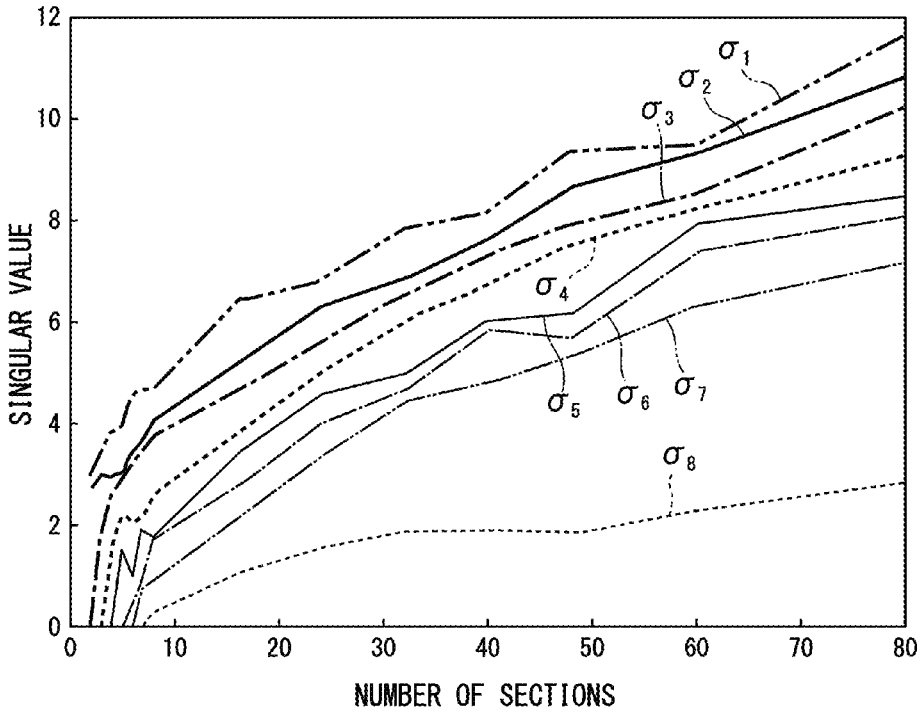
FIG. 11 is a diagram showing an example of dependency by the number of sections of a singular value.

FIG. 11 is a diagram showing an example of dependency by the number Q of sections of the singular value $\sigma_m$.

In FIG. 11, the vertical axis represents a singular value, and the horizontal axis represents the number Q of sections. As described above, the singular values $\sigma_1, \ldots,$ and $\sigma_8$ shown in FIG. 11 are calculated based on the delay sum element matrix C after a random value is set as the initial value of the phase difference $\theta_m$, and the phase difference $\theta_m$ sufficiently converges.

As shown in FIG. 11, the singular values $\sigma_1, \ldots,$ and $\sigma_8$ increase as the number Q of sections increases along with each order. When the number Q of sections is smaller than 8, there is at least one singular value which is zero or close to zero. That is, a right singular vector corresponding to at least one singular value has no effect of suppressing noise. When the number Q of sections is greater than 20, all the singular values $\sigma_1, \ldots,$ and $\sigma_8$ are greater than 1. That is, a right singular vector corresponding to each singular value has an effect of suppressing noise. In the experiment, since noise is incoming from only one direction, a case where seven singular values are (non-zero) singular values significantly different from zero, and one singular value should be a singular value which is zero or close to zero is considered. However, it is considered that eight non-zero singular values are obtained because of reflection by the inner wall of the experimental laboratory or an installation.

Next, another example of the singular value m calculated by the singular vector calculation unit 125 will be described.

Figure 12:
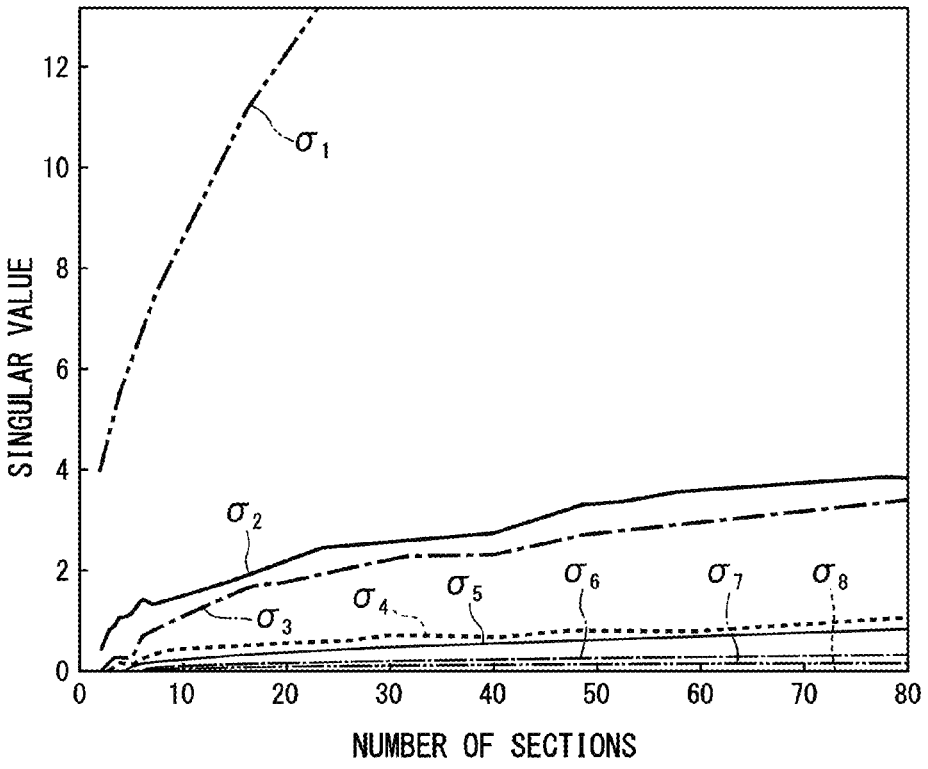
FIG. 12 is a diagram showing another example of dependency by the number of sections of a singular value.

FIG. 12 is a diagram showing another example of dependency by the number Q of sections of the singular value $\sigma_m$.

The relationship represented by the vertical axis and the horizontal axis in FIG. 12 is the same as FIG. 11. In this example, zero is set as all the initial values of the phase differences $\theta_m$, and calculation is performed based on the delay sum element matrix C obtained after the phase difference $\theta_m$ sufficiently converges.

The singular values $\sigma_1, \ldots,$ and $\sigma_8$ shown in FIG. 12 increase as the number of sections increases along with each order. However, the singular value $\sigma_1$ has significantly greater than the singular values $\sigma_2, \ldots,$ and $\sigma_8$. Even when the number of sections is 80, there are only two singular values $\sigma_2$ and $\sigma_3$ which exceed 1, in addition to the singular value $\sigma_1$. While as the number of sections increases, there is a possibility that there are more singular values exceeding 1, the amount of processing excessively increases. That is, from FIGS. 11 and 12, it is confirmed that, as in this embodiment, the random value is set as the initial value of the phase difference $\theta_m$, thereby efficiently calculating a singular vector and obtaining noise suppression performance using the calculated singular vector.

(Example of Output Acoustic Signal)

Next, an example of an output acoustic signal calculated by the time domain transform unit 127 in terms of the channel m will be described.

Figure 13:
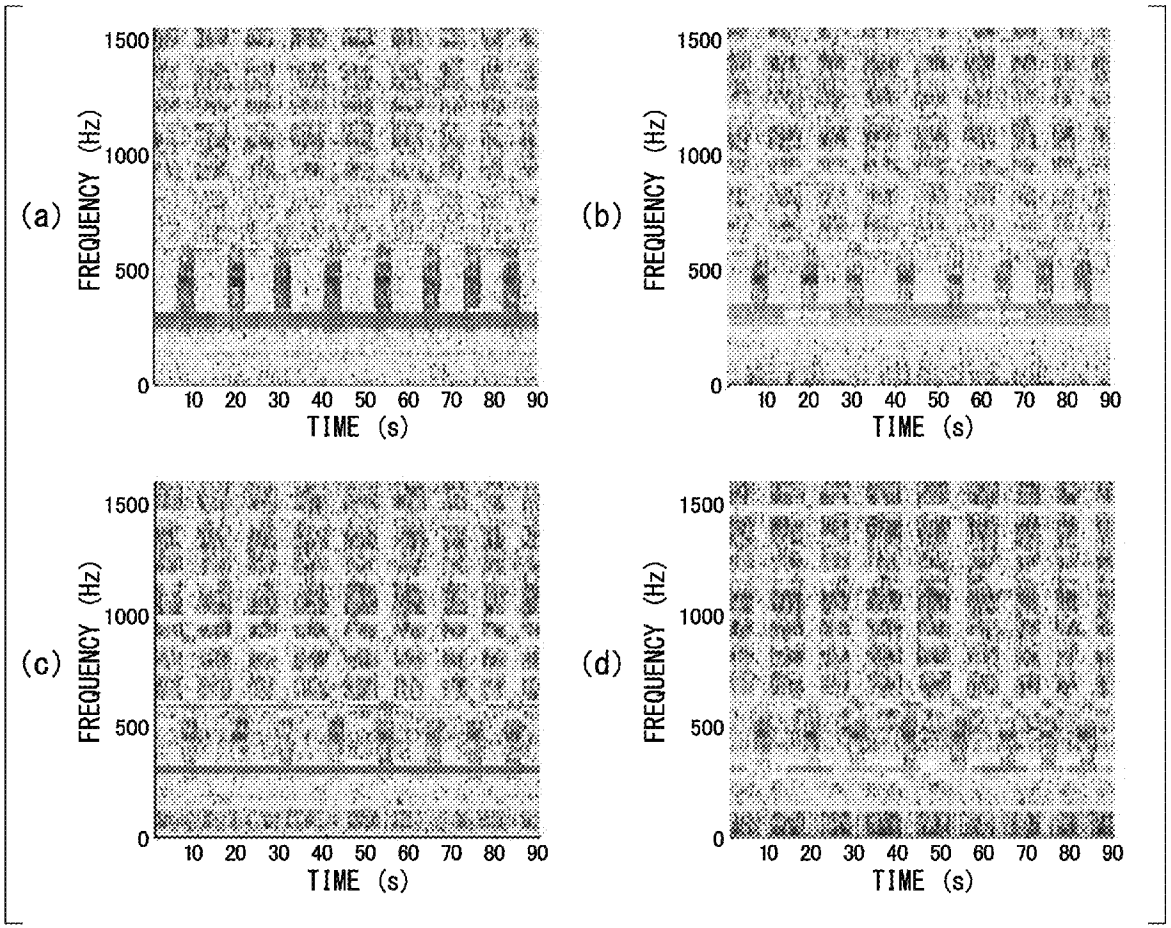
FIG. 13 is a diagram showing an example of a spectrogram of an output acoustic signal.

FIG. 13 is a diagram showing an example of a spectrogram of an output acoustic signal.

In FIG. 13, Part (a) represents a case where zero is set as all the initial values of the phase differences $\theta_m$, Part (b) represents a case where random values are set as the initial values of the phase differences $\theta_m$, Part (c) represents a case where random values different from Part (b) are set as the initial values of the phase differences $\theta_m$, and Part (d) represents a case where random values different from Part (b) and Part (c) are set as the initial values of the phase differences $\theta_m$. In all of Part (a) to Part (d), the vertical axis represents a frequency (Hz), the horizontal axis represents time (s), and the level of the output acoustic signal is represented by shading. A dark region represents that the level is low, and a bright region represents that the level is high.

All of Part (a) to Part (d) of FIG. 13 represent that there is a time zone in which the level increases intermittently over a wide frequency band. The time zone is a time zone in which target sound is incoming, and other time zones are time zones in which only noise is incoming. Part (a) of FIG. 13 represents that a region where the level of noise is high is widest. That is, Part (b) to Part (d) represent that random values are set as the initial values of the phase differences $\theta_m$, and thus noise is effectively suppressed.

Next, another example of the output acoustic signal calculated by the time domain transform unit 127 in terms of the channel m in a certain section will be described.

Figure 14:
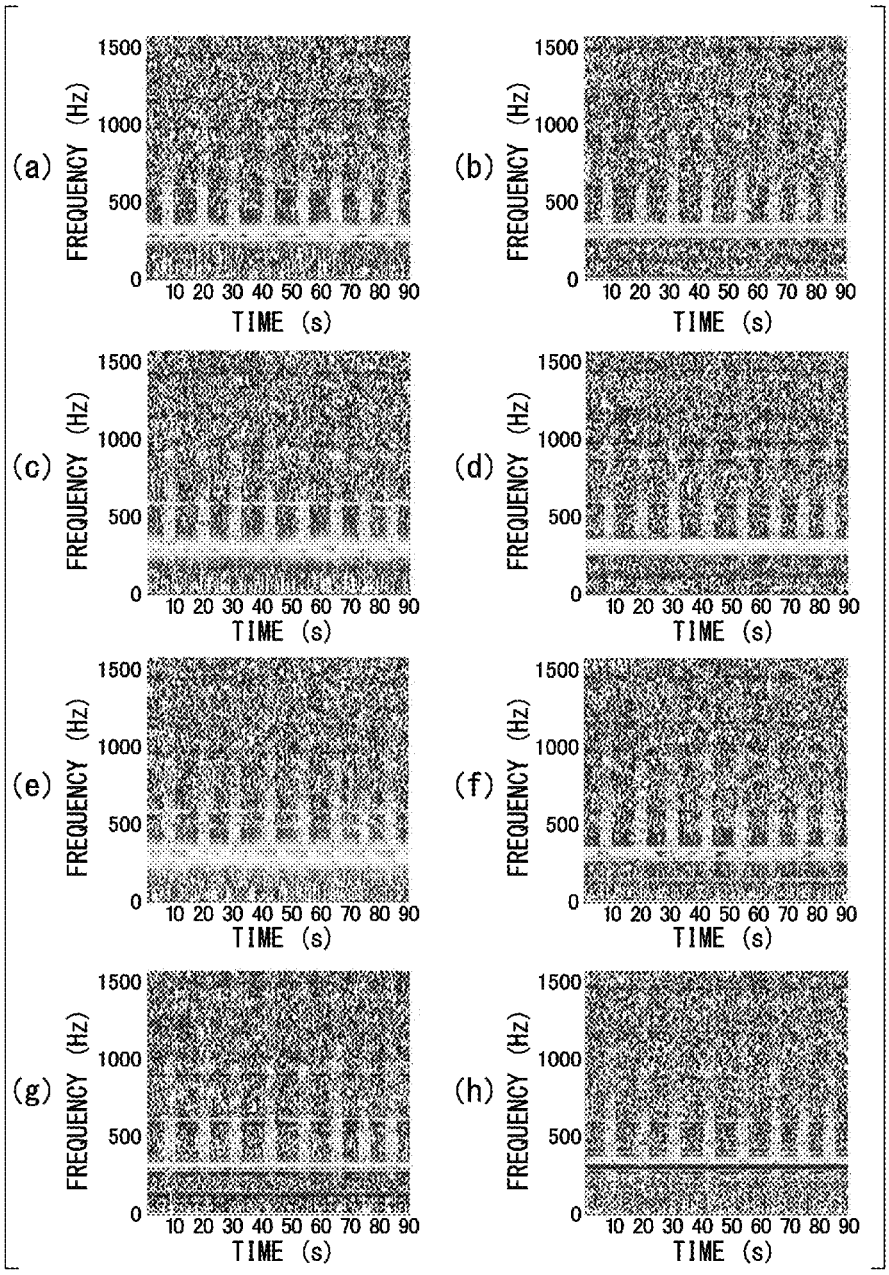
FIG. 14 is a diagram showing another example of a spectrogram of an output acoustic signal.

FIG. 14 is a diagram showing another example of a spectrogram of an output acoustic signal.

However, the output acoustic signal shown in FIG. 14 is a signal which is obtained by transforming the output frequency domain coefficient $Z_k$ obtained based on only one of each of the input signal vector $[y_k]$ and the right singular vectors $[v_1], \ldots,$ and $[v_8]$ to a time domain. These are called the output acoustic signals 1 to 8. The right singular vectors $[v_1], \ldots,$ and $[v_8]$ are based on the delay sum element matrix C calculated when random values are set as the initial values of the phase differences $\theta_m$.

The spectrograms of the output acoustic signals 1 to 8 are respectively shown in Part (a) to Part (h) of FIG. 14.

In regard to each of Part (a) to Part (h) of FIG. 14, the relationship between the vertical axis, the horizontal axis, and shading is the same as in Part (a) to Part (d) of FIG. 13. When focusing on a region where the level of noise is higher than in the vicinities, while the area of a region where the level of noise is substantially identical between Part (a) to Part (h) of FIG. 14, the level of noise shown in Part (h) of FIG. 14 is highest. That is, FIG. 14 represents that a noise component is concentrated on the output acoustic signal 8 (Part (h)), and noise is suppressed in the output acoustic signals 1 to 7 (Part (a) to Part (g)).

Figure 15:
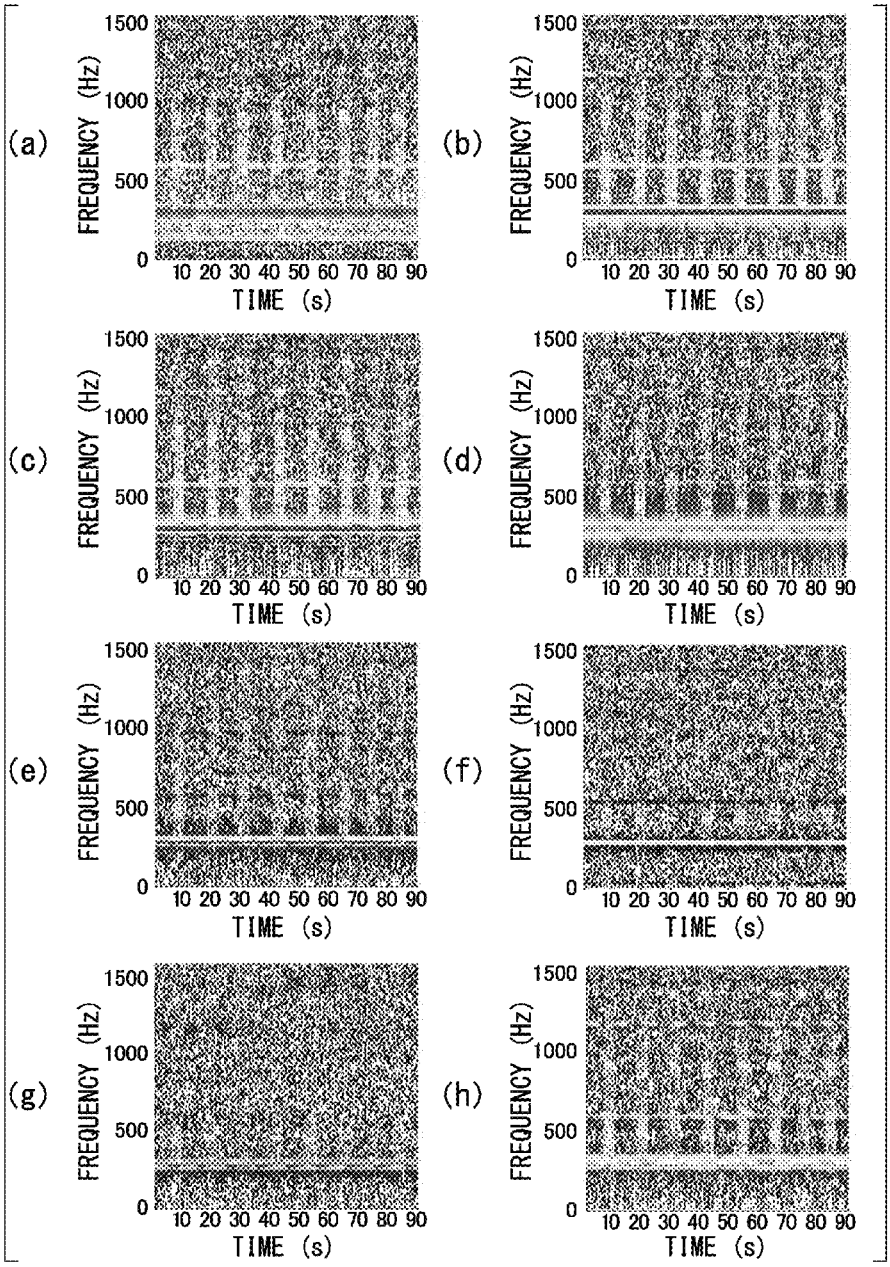
FIG. 15 is a diagram showing still another example of a spectrogram of an output acoustic signal.

FIG. 15 is a diagram showing yet another example of a spectrogram of an output acoustic signal.

Similarly to the output acoustic signals 1 to 8, an output acoustic signal shown in FIG. 15 is a signal which is obtained by transforming the output frequency domain coefficient $Z_k$ obtained based on only one of each of the input signal vector $[y_k]$ and the right singular vectors $[v_1], \ldots,$ and $[v_8]$ to a time domain. These are called output acoustic signals 1' to 8'. However, the right singular vectors $[v_1], \ldots,$ and $[v_8]$ are based on the delay sum element matrix C calculated when zero is set as all the initial values of the phase differences $\theta_m$.

The spectrograms of the output acoustic signals 1' to 8' are shown in Part (a) to Part (h) of FIG. 15. In regard to each of Part (a) to Part (h) of FIG. 15, the relationship between the vertical axis, the horizontal axis, and shading are the same as in Part (a) to Part (h) of FIG. 14. According to this, the area of a region where the level of noise is higher than the surrounding and the level of noise in the region differ between Part (a) to Part (h) of FIG. 15. Accordingly, if zero is set as the initial values of the phase differences $\theta_m$, since it is not possible to correctly calculate the delay sum element matrix C, noise is not necessarily effectively suppressed.

(Example of Average MUSIC Spectrum)

Next, an example of the average MUSIC spectrum $P_{avg}(\phi)$ to be calculated by the direction calculation unit 2213 will be described.

Figure 16:
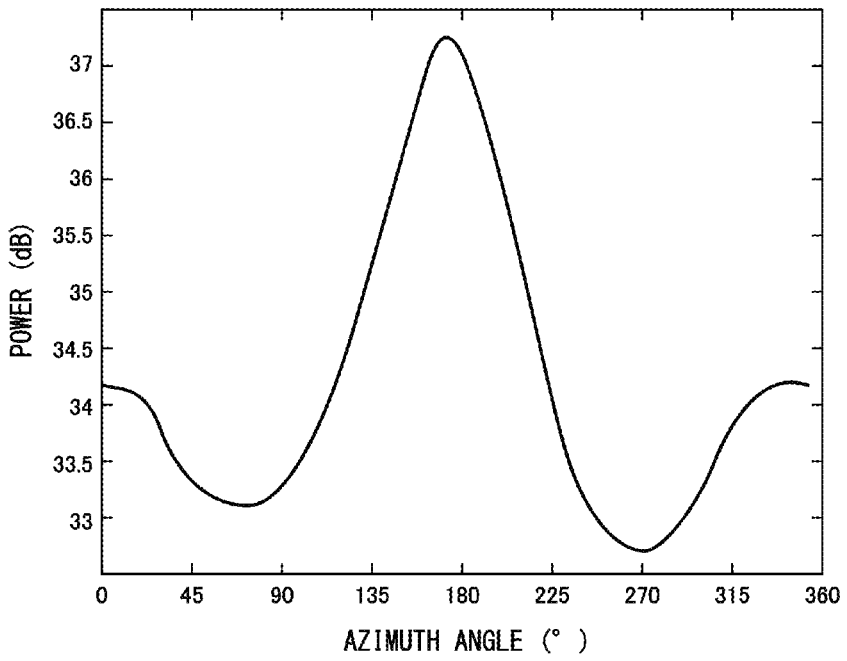
FIG. 16 is a diagram showing an example of an average MUSIC spectrum.

FIG. 16 is a diagram showing an example of the average MUSIC spectrum $P_{avg}(\phi)$.

In FIG. 16, a horizontal axis represents an azimuth angle (°), and the vertical axis represents power (dB) of the average MUSIC spectrum $P_{avg}(\phi)$.

FIG. 16 shows a peak at which power of the average MUSIC spectrum $P_{avg}(\phi)$ is maximized at the azimuth angle 180°. The direction calculation unit 2213 defines the azimuth angle 180°, which gives a peak with maximum power, as the direction of the sound source.

(Example of Sound Source Direction)

Next, an example of the direction $\phi$ of the sound source defined by the direction calculation unit 2213 will be described.

Figure 17:
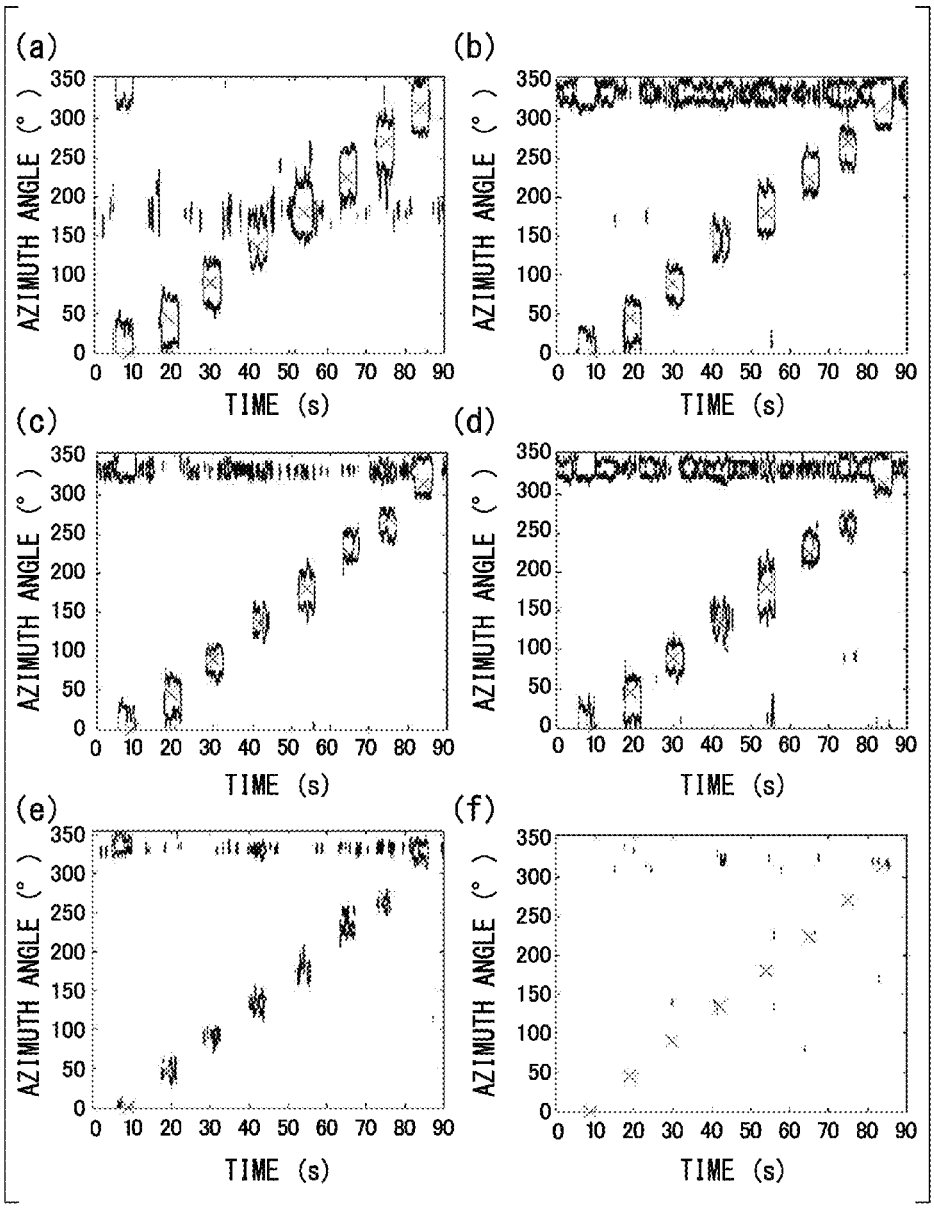
FIG. 17 is a diagram showing an example of a direction of a sound source defined by a direction calculation unit according to this embodiment.

FIG. 17 is a diagram showing an example of the direction $\phi$ of the sound source defined by the direction calculation unit 2213 according to this embodiment.

As described above, the conjugate transpose matrix $[V_c]^H$ which is used when calculating the MUSIC spectrum $P(\phi)$ is generated by integrating the M' right singular vectors $[v_1], \ldots,$ and $[v_{M'}]$.

Part (a) to Part (f) of FIG. 17 represent the direction $\phi$ when the number M' of right singular vectors included in the conjugate transpose matrix $[V_c]^H$ is 8 to 3. In an experiment, sound sources are installed at different times at the directions 0°, 45°, 90°, 135°, 180°, 225°, 270°, and 315° from the signal input unit 11, and sound is generated.

In Part (a) to Part (f) of FIG. 17, the horizontal axis represents time (s), and the vertical axis represents an azimuth angle (°). A symbol x represents a direction of a sound source which emits target sound.

Part (a) of FIG. 17 represents that, when the number M' of right singular vectors is 8, the direction $\phi$ of a sound source can be estimated with the highest precision.

Part (b) to Part (e) of FIG. 17 represent that, when the number M' of right singular vectors is 7 to 4, the direction $\phi$ of the sound source can be substantially estimated in an actual direction of a sound source. However, it may be estimated that, even if there is no sound source actually, the direction $\phi$ of a sound source is about 330°.

Part (f) of FIG. 17 represents that, if the number M' of right singular vectors decreases to 3, it is not possible to practically estimate the direction $\phi$ of a sound source. This is because the number of channels of the output acoustic signal decreases, making it difficult to sufficiently use a vector space in which noise from a specific direction is suppressed.

Next, an example of the direction $\phi$ of a sound source estimated using a MUSIC method of the related art under the same conditions as the above-described experiment will be described.

Figure 18:
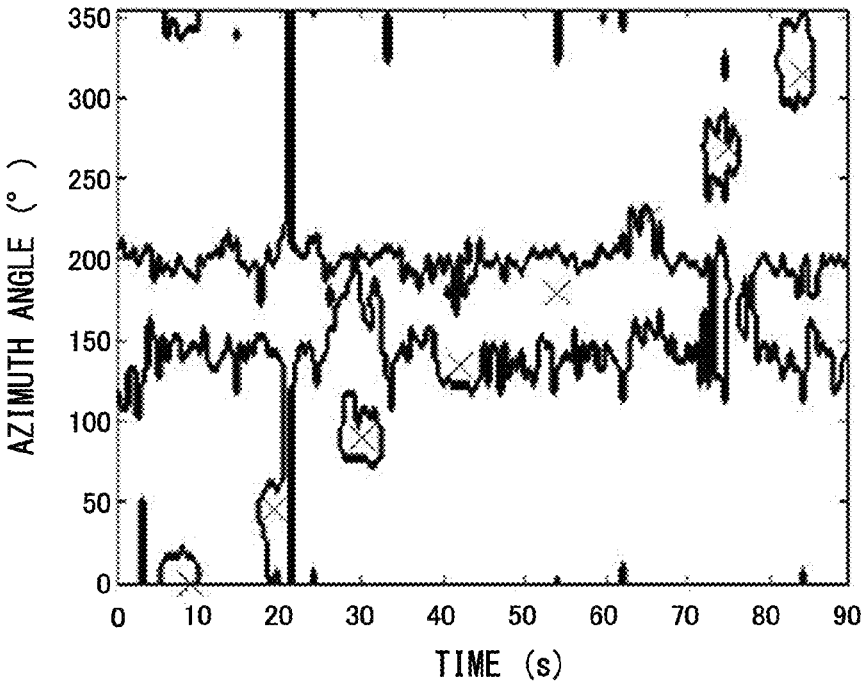
FIG. 18 is a diagram showing an example of a direction of a sound source estimated using a MUSIC method of the related art.

FIG. 18 is a diagram showing an example of the direction $\phi$ of a sound source estimated using a MUSIC method of the related art.

In FIG. 18, the relationship between the vertical axis and the horizontal axis is the same as in FIG. 17.

FIG. 18 represents that the direction of a noise source installed at the azimuth angle 180° is constantly estimated as the direction $\phi$ of a sound source. That is, unlike this embodiment, noise is not suppressed. FIG. 18 represents that, when a direction of a sound source is 135°, 180°, and 225°, it is not possible to distinguish a noise source. Since a frequency band of a spectrum of noise emitted from a noise source and a frequency band of a spectrum of target sound emitted from a sound source overlap each other, it is not possible to distinguish between both the noise source and the sound source. In other words, in this embodiment, unlike the MUSIC method of the related art, the effects of extracting a component of target sound from a sound source in the same direction as the noise source or a direction close to the noise source and estimating the direction having not been obtained by the MUSIC method of the related art are obtained.

As described above, this embodiment has the configuration of the first embodiment, and diagonalizes the correlation matrix calculated based on the output signal calculated in the first embodiment to calculate the eigenvector. In this embodiment, a spectrum for each direction is calculated based on the calculated eigenvector, the singular vector calculated in the first embodiment, and the transfer characteristic for each direction, and a direction in which the calculated spectrum is maximized is defined.

For this reason, in this embodiment, since the same effects as in the first embodiment are obtained, since noise is suppressed and target sound is left, it is possible to estimate the direction of the left target sound with high precision.

A part of the acoustic signal processing device 12 or 22 of the foregoing embodiment, for example, the frequency domain transform unit 121, the input signal matrix generation unit 122, the initial value setting unit 123, the delay sum element matrix calculation unit 124, the singular vector calculation unit 125, the output signal vector calculation unit 126, the time domain transform unit 127, and the direction estimation unit 221 may be realized by a computer. In this case, a program for realizing a control function may be recorded in a computer-readable recording medium, a computer system may read the program recorded on the recording medium and executed to realize the control function. The term "computer system" used herein is a computer system embedded in the acoustic signal processing device 12 or 22, and includes an OS and hardware, such as peripherals. The term "computer-readable recording medium" refers to a portable medium, such as a flexible disk, a magneto-optical disk, a ROM, or a CD-ROM, or a storage device, such as a hard disk embedded in the computer system. The term "computer-readable recording medium" includes a medium which dynamically holds the program in a short time, such as a communication line when the program is transmitted through a network, such as Internet, or a communication line, such that a telephone line, or a medium which holds the program for a given time, such as a volatile memory inside a computer system serving as a server or a client. The program may realize a part of the above-described functions, or may realize all the above-described functions in combination with a program recorded in advance in the computer system.

A part or the entire part of the acoustic signal processing device 12 or 22 of the foregoing embodiment may be realized as an integrated circuit, such as large scale integration (LSI). Each functional block of the acoustic signal processing device 12 or 22 may be individually implemented as a processor, and a part or the entire part may be integrated and implemented as a processor. A method for an integrated circuit is not limited to LSI, and may be realized by a dedicated circuit or a general-purpose processor. With advancement of a semiconductor technology, when a technology for an integrated circuit as a substitute for LSI appears, an integrated circuit by the technology may be used.

Although an embodiment of the invention has been described referring to the drawings, a specific configuration is not limited to those described above, and various changes in design and the like may be made within the scope without departing from the spirit of the invention.

What is claimed is:

1. An acoustic signal processing device comprising:

a frequency domain transform unit configured to transform an acoustic signal to a frequency domain signal for each channel;

a filter coefficient calculation unit configured to calculate at least two sets of filter coefficients of a filter for each section having a predefined number of frames with respect to a sampled signal obtained by sampling the frequency domain signal transformed by the frequency domain transform unit for each frame such that the magnitude of a residual calculated based on a filter compensating for the difference in transfer characteristics between the channels of the acoustic signal is minimized; and an output signal calculation unit configured to calculate an output signal of a frequency domain based on the frequency domain signal transformed by the frequency domain transform unit and at least two sets of filter coefficients calculated by the filter coefficient calculation unit.

2. The acoustic signal processing device according to claim 1, wherein the difference in the transfer characteristic between the channels is a phase difference, the filter is a delay sum element based on the phase difference, and the acoustic signal processing device further includes an initial value setting unit configured to set a random number for each channel and frame as an initial value of the phase difference.

3. The acoustic signal processing device according to claim 2, wherein the random number which is set as the initial value of the phase difference is a random number in a phase domain, and the filter coefficient calculation unit recursively calculates a phase difference which gives a delay sum element to minimize the magnitude of the residual using the initial value set by the initial value setting unit.

4. The acoustic signal processing device according to claim 1, further comprising:

a singular vector calculation unit configured to perform singular value decomposition on a filter matrix having at least two sets of filter coefficients as elements to calculate a singular vector, wherein the output signal calculation unit is configured to calculate the output signal based on the singular vector calculated by the singular vector calculation unit and an input signal vector having the frequency domain signal as elements.

5. The acoustic signal processing device according to claim 4, wherein the output signal calculation unit calculates the output signal based on a singular vector corresponding to a predefined number of singular values in a descending order from a maximum singular value in the singular vector calculated by the singular vector calculation unit.

6. An acoustic signal processing method comprising:

a first step of transforming an acoustic signal to a frequency domain signal for each channel;

a second step of calculating at least two sets of filter coefficients of a filter for each section having a predefined number of frames with respect to a sampled signal obtained by sampling the frequency domain signal transformed in the first step for each frame such that the magnitude of a residual calculated based on a filter compensating for the difference in transfer characteristics between the channels of the acoustic signal is minimized; and a third step of calculating an output signal of a frequency domain based on the frequency domain signal transformed in the first step and at least two sets of filter coefficients calculated in the second step.

* * * * *